US009546545B2

(12) United States Patent
Cardellini et al.

(10) Patent No.: US 9,546,545 B2
(45) Date of Patent: Jan. 17, 2017

(54) MULTI-LEVEL WELLSITE MONITORING SYSTEM AND METHOD OF USING SAME

(71) Applicant: National Oilwell Varco, L.P., Houston, TX (US)

(72) Inventors: David A. Cardellini, Spring, TX (US); Matthew D. Becker, Alta Loma, CA (US); Richard Lee Murray, Jr., Foothill Ranch, CA (US)

(73) Assignee: NATIONAL OILWELL VARCO, L.P., Houston, TX (US)

( * ) Notice: Subject to any disclaimer, the term of this patent is extended or adjusted under 35 U.S.C. 154(b) by 0 days.

(21) Appl. No.: 14/822,647

(22) Filed: Aug. 10, 2015

(65) Prior Publication Data

US 2015/0345281 A1 Dec. 3, 2015

Related U.S. Application Data

(63) Continuation-in-part of application No. 13/375,864, filed as application No. PCT/US2010/036189 on May 26, 2010, now Pat. No. 9,133,668.

(60) Provisional application No. 61/183,282, filed on Jun. 2, 2009.

(51) Int. Cl.
*G01V 3/00* (2006.01)
*E21B 47/00* (2012.01)

(52) U.S. Cl.
CPC ..... *E21B 47/0006* (2013.01)

(58) Field of Classification Search
CPC ..... E21B 47/00
USPC ..... 340/853.1, 853.2
See application file for complete search history.

(56) References Cited

U.S. PATENT DOCUMENTS

| | | | |
|---|---|---|---|
| 2,116,120 | A | 5/1938 | Malmgren |
| 2,380,520 | A | 7/1945 | Hassler |
| 2,639,588 | A | 5/1953 | Durant et al. |
| 2,676,787 | A | 4/1954 | Johnson |
| 3,037,295 | A | 6/1962 | Roberson |
| 3,042,998 | A | 7/1962 | Sweett et al. |

(Continued)

FOREIGN PATENT DOCUMENTS

| | | |
|---|---|---|
| CA | 2761955 | 12/2010 |
| GB | 2352743 | 2/2001 |
| WO | 03058029 | 7/2003 |

OTHER PUBLICATIONS

Besaisow et al., "Application of ADAMS (Advanced Drillstring Analysis and Measurement System) and Improved 1 Drilling Performance," SPE 19998, SPE Annual Technical Conference and Exhibition, Feb. 27-Mar. 2, 1990, 0 Houston, Texas.

(Continued)

*Primary Examiner* — Amine Benlagsir
(74) *Attorney, Agent, or Firm* — Conley Rose, P.C.

(57) ABSTRACT

A system for monitoring wellsite equipment at a wellsite is disclosed. The system includes a plurality of client devices. Each client device has radios with programmable channels. The client devices include a source client device, a base station client device, and a repeater client device. The source client device is mounted to the wellsite equipment and includes a sensor to measure wellsite parameters of the wellsite equipment. The base station client device is coupled to the surface unit for communication therewith. The repeater client device is positioned at the wellsite to communicate with the source client device and the base station client device.

22 Claims, 15 Drawing Sheets

(56) References Cited

U.S. PATENT DOCUMENTS

| | | | | |
|---|---|---|---|---|
| 3,109,501 | A | 11/1963 | Pugh | |
| 3,279,404 | A | 10/1966 | Richardson | |
| 3,390,654 | A | 7/1968 | Bromell et al. | |
| 3,402,343 | A | 9/1968 | Brown et al. | |
| 3,482,629 | A | 12/1969 | Suman, Jr. | |
| 4,491,022 | A | 1/1985 | de la Cruz | |
| 4,616,321 | A | 10/1986 | Chan | |
| 5,144,126 | A | 9/1992 | Perry et al. | |
| 5,155,916 | A | 10/1992 | Engebretson | |
| 6,018,301 | A * | 1/2000 | Smith | E21B 47/011 340/853.7 |
| 6,429,787 | B1 | 8/2002 | Pyne et al. | |
| 6,439,325 | B1 | 8/2002 | Peters et al. | |
| 6,956,791 | B2 | 10/2005 | Dopf et al. | |
| 7,108,081 | B2 | 9/2006 | Boyadjieff | |
| 7,591,304 | B2 | 9/2009 | Juhasz et al. | |
| 7,595,737 | B2 * | 9/2009 | Fink | E21B 47/16 175/40 |
| 7,757,759 | B2 | 7/2010 | Jahn et al. | |
| 9,133,668 | B2 | 9/2015 | Cardellini et al. | |
| 2001/0049049 | A1 | 12/2001 | Hensley et al. | |
| 2002/0039328 | A1 * | 4/2002 | Dubinsky | E21B 47/16 367/82 |
| 2002/0156730 | A1 * | 10/2002 | Newman | G06Q 10/10 705/40 |
| 2003/0236628 | A1 | 12/2003 | Martorana et al. | |
| 2004/0251048 | A1 | 12/2004 | Kurkoski | |
| 2005/0056461 | A1 | 3/2005 | Estes et al. | |
| 2005/0197777 | A1 | 9/2005 | Rodney et al. | |
| 2005/0285753 | A1 * | 12/2005 | Shah | E21B 47/12 340/854.9 |
| 2006/0219438 | A1 * | 10/2006 | Moore | E21B 47/122 175/50 |
| 2006/0256718 | A1 * | 11/2006 | Hall | H04L 5/14 370/230 |
| 2007/0017682 | A1 * | 1/2007 | Abrahamsen | E21B 44/00 166/379 |
| 2007/0030167 | A1 | 2/2007 | Li et al. | |
| 2007/0153817 | A1 * | 7/2007 | Osann | H04W 84/00 370/406 |
| 2007/0215343 | A1 | 9/2007 | McDonald et al. | |
| 2008/0007421 | A1 * | 1/2008 | Liu | G01V 11/002 340/853.3 |
| 2008/0033653 | A1 * | 2/2008 | Pabon | G01V 1/44 702/6 |
| 2008/0164025 | A1 | 7/2008 | Peter | |
| 2008/0202810 | A1 | 8/2008 | Gomez | |
| 2009/0193993 | A1 | 8/2009 | Hummel et al. | |
| 2009/0266611 | A1 * | 10/2009 | Camp | E21B 47/024 175/45 |
| 2009/0289808 | A1 | 11/2009 | Prammer | |
| 2010/0051292 | A1 | 3/2010 | Trinh et al. | |
| 2010/0193198 | A1 | 8/2010 | Murray et al. | |
| 2010/0224409 | A1 | 9/2010 | Sarhad et al. | |
| 2011/0098931 | A1 * | 4/2011 | Kosmala | E21B 47/00 702/12 |
| 2011/0226485 | A1 | 9/2011 | Seneviratne et al. | |
| 2012/0080227 | A1 | 4/2012 | Cardellini et al. | |

OTHER PUBLICATIONS

Besaisow et al., "Development of a Surface Drillstring Vibration Measurement System," SPE 14327, SPE Annual 0 Technical Conference and Exhibition, Sep. 22-26, 1985, Las Vegas, Nevada.

Noble Corporation, "Instrumented Surface Sub DOE Project (DE-FC26-03NT41782)" [online], [retrieved on Nov. 5, 2012]. Retrieved from the internet <URL: http://www.netl.doe.gov/technologies/oil-gas/publications/EPreportsIDCSI 0 Participant%20Presentation.ppt>, pp. 1-12.

National Energy Technology Laboratory, Oil & Natural Gas Projects, Exploration & Production Technologies, "Drilling Optimization Utilizing Surface Instrumentation for Downhole Event Recognition" [online], [retrieved on Nov. 5, 2012]. Retrieved from the internet <URL:http://www.netl.doe.gov/technologies/oil-gas/NaturalGas/Projects_n/EPIDCSIDCS_A_41782DriliOpt.html>, 2 pages.

Cohen, et al. "Drilling Optimization Utilizing Surface Instrumentation for Downhole Event Recognition, Final Report, Sep. 30, 2003 to Dec. 31, 2005," Maurer Technology, Inc., Feb. 2006, 64 pgs.

* cited by examiner

MULTI-LEVEL WELLSITE MONITORING SYSTEM AND METHOD OF USING SAME

CROSS-REFERENCE TO RELATED APPLICATIONS

This application is a continuation-in-part application of prior U.S. patent application Ser. No. 13/375,864 filed Dec. 2, 2011 which was the National Stage of International Application No. PCT/US2010/036189, filed May 26, 2010, which claims the benefit of U.S. Provisional Application No. 61/183,282, filed on Jun. 2, 2009, the entire contents of which are hereby incorporated by reference herein.

BACKGROUND

The disclosure relates generally to techniques for performing wellsite operations. More particularly, the disclosure relates to sensing, monitoring, and communicating about a wellsite.

Oilfield operations may be performed to locate and gather valuable downhole fluids. Downhole drilling tools are advanced into subterranean formations to form wellbores to reach subsurface reservoirs. The drilling tools include a drill string, a bottomhole assembly, and a drill bit assembled at a surface rig using surface equipment. The surface equipment includes a top drive used to threadedly connect stands of drill pipe together to form the drill string. Fluid from a mud pit is passed through the drill string and out the bit to facilitate drilling.

Real-time measurement of various parameters related to a drilling rig operation may be used during execution of the drilling rig operation. Sensing devices may be provided to sense various drilling parameters during drilling and other wellsite operations. A drilling rig assembly may incorporate one or more sensors on one or more members, e.g. a pipe running tool or top drive shaft, for sensing the desired parameters. Data transmission from the sensors may use electric slip rings or inductive pickup devices. Examples of drilling devices are provided in U.S. Patent/Application Nos. 20110226485, U.S. Pat. Nos. 7,591,304 and 7,108,081, the entire contents of which are hereby incorporated by reference herein.

Despite the advancements in transmission at the wellsite, sensors and other devices may require precise alignment and close tolerances for successful operation, and may not be well-suited to the harsh drilling rig environment.

SUMMARY

In some embodiments, a system for monitoring a drilling rig operation comprises a drilling rig assembly. At least one sensor is coupled to a member of the drilling rig assembly to sense a parameter related to operation of the drilling rig assembly. A client device coupled to the at least one sensor includes a data acquisition device for receiving data from the at least one sensor. The client device also includes a first radio, which is coupled to the data acquisition device. A base station located a distance from the client device includes a second radio that communicates wirelessly with the first radio in order to transfer data between the data acquisition device and the base station.

In other embodiments, a wireless transmission system comprises a client device having a data acquisition device for receiving data from at least one sensor and a first radio coupled to the data acquisition device. The system further includes a base station having a second radio that communicates wirelessly with the first radio in order to transfer data between the data acquisition device and the base station.

In yet other embodiments, a method of monitoring a drilling rig operation comprises sensing a parameter related to the drilling rig operation using at least one sensor coupled to a member of a drilling rig assembly. Data is collected from the at least one sensor using a data acquisition device of a client device coupled to the at least one sensor. The data collected by the data acquisition device is transmitted wirelessly to a base station located at a distance from the data acquisition device using a first radio coupled to the data acquisition device and a second radio coupled to the base station.

In at least one aspect, the disclosure relates to a system for monitoring a drilling rig operation includes a drilling rig assembly and at least one sensor coupled to a member of the drilling rig assembly to sense a parameter related to operation of the drilling rig assembly. A client device coupled to the at least one sensor includes a data acquisition device for receiving data from the at least one sensor. The client device also includes a first radio, which is coupled to the data acquisition device. A base station located a distance from the client device comprises a second radio that communicates wirelessly with the first radio in order to transfer data between the data acquisition device and the base station.

In another aspect, the disclosure relates to a system for monitoring wellsite equipment at a wellsite. The system includes a plurality of client devices comprising radios with programmable channels. The plurality of client devices includes a source client device mounted to the wellsite equipment, the source client device further comprising a sensor to measure wellsite parameters of the wellsite equipment; a base station client device coupled to a surface unit to communicate therewith; and a repeater client device positioned at the wellsite to communicate with the source client device and the base station client device, and/or other repeater client devices.

The client devices may include an internal power supply, an external power supply, an encoder, additional sensors and/or electronics. Each of the client devices includes a housing with the radios therein. The client devices include a connector connectable to the housing and a cable extending from the connector for connection to additional components. The additional components include an external power supply, an encoder, additional sensors and/or electronics. The housing includes a base and a cap. Each of the client devices also includes an electronics board supported in the housing. The electronics include a processor, a memory, an interface, an antenna, and/or a power supply. The wellsite equipment includes a link tilt, a top drive, an instrumented sub, and/or a rig. The sensors include a proximity sensor, a gyro, a magnetometer, a Hall effect sensor, an accelerometer, an encoder, and/or a strain gauge.

The system also includes a control and acquisition unit integral with or coupled to the surface unit. The control and acquisition unit includes a processor, a controller, a network switch, a memory, a display device, and/or peripheral. The base unit client device includes a plurality of base unit client devices coupled to another of the base unit client devices and/or the surface unit. The system includes communication links between radios of each of the client devices when at a same channel of the programmable channels. The system may also include a surface unit positioned at the wellsite (the surface unit including a processor), and/or an identifier detectable by the sensor to determine a position of the wellsite equipment.

In another aspect, the disclosure relates to a method of monitoring a wellsite equipment at a wellsite. The method involves positioning client devices about a wellsite (each client device having radios with channels); assigning the client devices roles as a source client device, a repeater client device, and a base station client device (the source client device being mounted to the wellsite equipment, the base station client device being positioned in communication with the surface unit, and the repeater client device being positioned at the wellsite in communication with the source client device and the base station client device); configuring a channel of a first radio of the each client device to the same channel of a second radio of another client device for transmission of data therebetween, measuring wellsite parameters with a sensor of the source client device, and transmitting the wellsite parameters to the base station via the channels of the radios.

The method also involves collecting wellsite parameters from external sensors with the source and/or toggling the source between an on and off position based on the measuring. The transmitting involves passing the wellsite parameters via a channel of the first radio of the source client device to a channel of the second radio of the base station client device, passing the wellsite parameters via the channel of the first radio of the source client device to the channel of the second radio of the base station client device via the repeater client device, passing the wellsite parameters from the base station client device to the surface unit, and/or receiving the wellsite parameters on a channel of the second radio of the repeater client device while simultaneously sending wellsite parameters on a channel of the first radio of the repeater client device.

The scope of embodiments of the present disclosure will be apparent from the following description and the appended claims.

BRIEF DESCRIPTION DRAWINGS

The accompanying drawings, described below, illustrate various exemplary embodiments of the invention and are not to be considered limiting of the scope of the disclosure, for the disclosure may admit to other equally effective embodiments. The figures are not necessarily to scale, and certain features and certain views of the figures may be shown exaggerated in scale or in schematic in the interest of clarity and conciseness.

DETAILED DESCRIPTION

The description that follows includes exemplary systems, apparatuses, methods, and instruction sequences that embody techniques of the inventive subject matter. However, it is understood that the described embodiments may be practiced without these specific details.

Wireless Transmission System

The disclosure relates generally to transmission of data between a drilling rig assembly and a control and acquisition system during a drilling rig operation. More particularly, the invention relates to transmission of data from sensors located on a rotatable or non-rotatable member of a drilling rig assembly to a control and acquisition system during a drilling rig operation.

Figure 1:
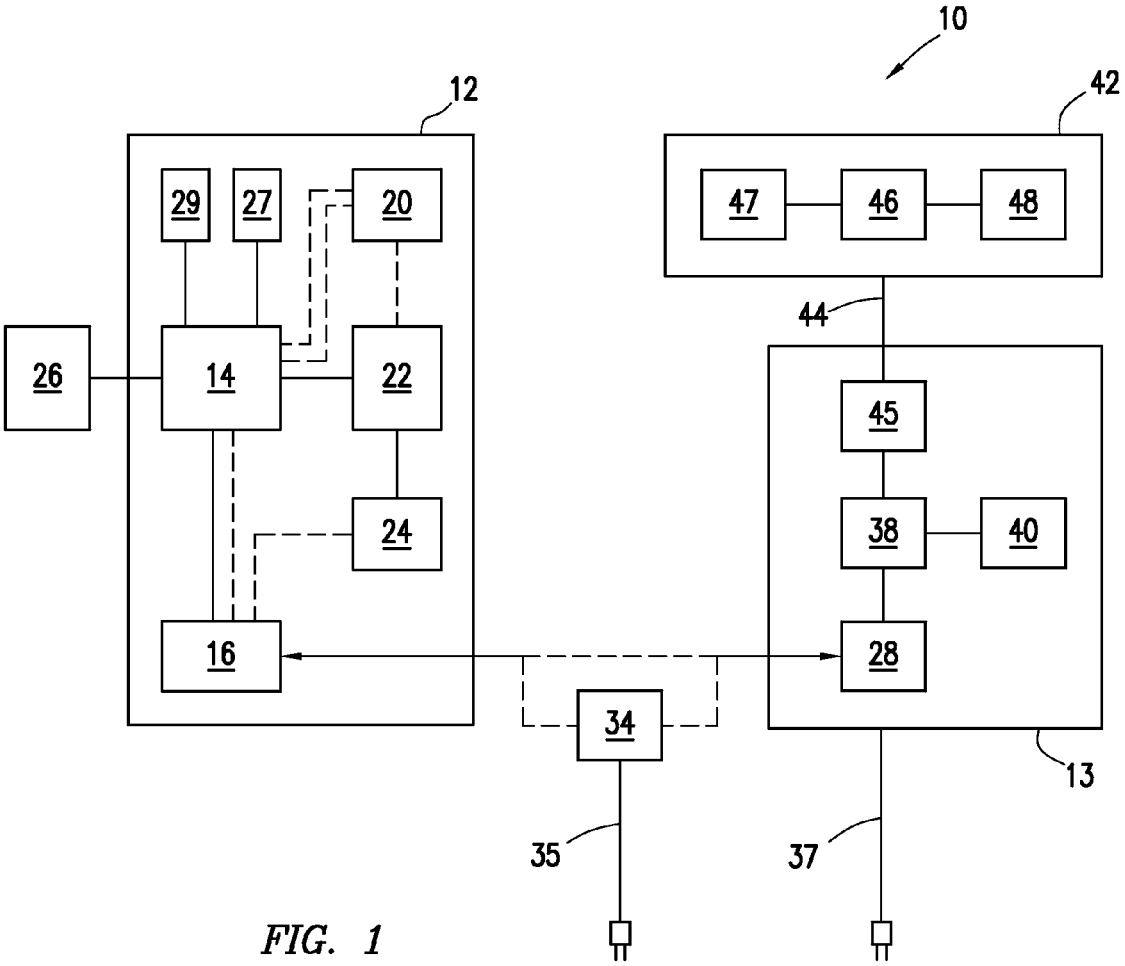
FIG. 1 is a diagram of a wireless transmission system.

FIG. 1 is a diagram of a wireless transmission system 10 including a client device 12, a base station 13, and a control and acquisition system (or unit) 42. The client device 12 includes a data acquisition device 14, radio 16, and battery 20. The client device 12 may further include processor 22, memory 24, one or more accelerometers 27, e.g., single-axis or multi-axis MEMS ("micro-electro-mechanical systems") accelerometer, and one or more gyroscopes 29, e.g., MEMS gyroscopes. The processor 22 may include, for example, an input/output interface, a clock, a CPU, RAM, and ROM (none of these components are shown separately). The battery 20 powers the components of the client device 12 as needed. Alternatively, as will be explained below, the components of the client device 12 may be powered autonomously by harvested energy.

The client device 12 may also be equipped with redundant sensors for use in a collision avoidance system of drilling assembly tools. Modern drilling rigs use computerized control systems to assist operators in controlling tools on the drilling rig. The many various tools on the drilling rig frequently operate in the same areas at the same time. It is imperative that these tools do not interfere or collide with each other. The control systems use sensors to warn the operators of potential collisions or interference, or to shut down the tools to prevent collisions. A classic example is the driller hoisting a traveling block in a derrick. Sensors are used to tell the driller when the traveling block gets too close to the top of the derrick so that the driller can stop the traveling block before a collision occurs. Or, the drawworks can be shut down automatically and the brake applied to prevent a collision.

The data acquisition device 14 collects data from sensors 26 that monitor wellsite parameters, such as parameters related to a drilling operation. As used herein, the term "sensor" refers to any one of a source (that emits or transmits energy or signals), a receiver (that receives or detects energy or signals), and a transducer (that operates as either a source or a receiver). Examples of sensors 26 include, but are not limited to, strain gauges, thermocouples, load cells, and transducers. In use, the sensors 26 may be located on a rotatable or non-rotatable member of a drilling rig assembly in order to measure various parameters related to use of the drilling rig assembly. Examples of measurements that could be made by sensors 26 include, but are not limited to, top drive shaft bending moment, top drive torque, top drive tension, drilling rig hoist load, weight-on-bit and other related drilling data, and rotational alignment of downhole tools.

The data acquisition device 14 observes external signal inputs and onboard signal inputs. The external signals may be, for example, signals from the sensors 26. The onboard signals may be, for example, signals from a high-speed counter driven by the clock of the processor 22, the output of the accelerometer 27, the output of the gyroscope 29, and life indicator signal from the battery 20. The data acquisition device 14 samples, filters, and stores data to pre-selected data channels.

The data acquisition device 14 allows for each data channel to have its own unique and user-configurable sample rate, filter type, and storage rate. For example, the output of the accelerometer 27 may be used to catch transients during shock loading, which may use very high sample rates, while the output of the gyroscope 29 may be used to sense whether a member is stationary, which may use very low sample rates relative to the aforementioned accelerometer output. In this instance, the data acquisition device 14 allows for two data channels to be configured, one to receive the accelerometer signals at the high sample rates and another to receive the gyroscope signals at the low sample rates. Also, several data channels can be activated to monitor the same signal output, where each data channel would be with a different sample rate, filter type, and storage rate. For example, the gyroscope 29 may be used to sense whether a member is stationary and to measure the rotational position of the member, the latter may employ a new data channel and a higher sample rate and storage rate. In this instance, the data acquisition device 14 allows for two data channels to be configured, one to receive the gyroscope signals indicative of whether the member is stationary and another to receive the gyroscope signals indicative of the rotational position of the member. In general, the data acquisition device 14 can allow as many data channels as needed to be configured with a specific sample rate, filter type, and storage rate.

Data in the pre-selected data channels are transmitted to the base station 13 and/or may be stored in memory 24. Like the sample rate, filter type, and storage rate, the transmission rate for each data channel is also unique and user-configurable. This allows for a much more power-efficient monitoring scheme. For example, a signal with a high sample rate and storage rate can be configured to have a low transmission rate, thus reducing the number of transmissions and reducing the amount of power used while still capturing large amounts of data. On the other hand, if the signal has real-time importance, then it can be configured to have a high transmission rate.

Figure 2:
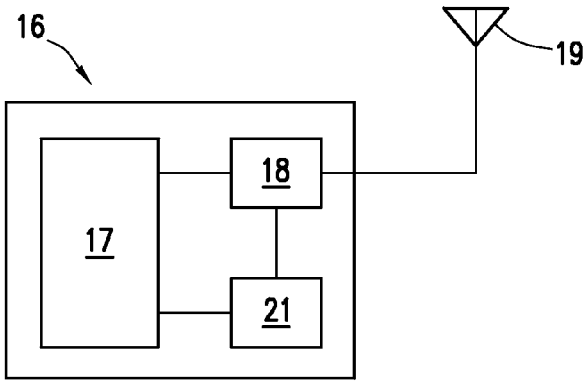
FIG. 2 is a diagram of a radio.

The radio 16 is used to transmit data from the data acquisition device 14 (or memory 24) to the base station 13. In order to conserve energy, the radio 16 is preferably a micro-power radio. On the other hand, micro-power technology can enable the client device 12 to run without a battery. Energy for running the device can be harvested from external sources, captured, and stored and used to run the client device 12. Energy can be harvested from, for example, ambient vibrations, wind, heat or light, which would enable the device to function autonomously and indefinitely. Preferably, the micro-power radio is based on IEEE 802.15.4 standard. In certain aspects, the radio 16 may be a ZigBee radio, which is based on the IEEE 802.15.4 standard. ZigBee technology is used as an example herein and is by no means the only example of a micro-power radio technology that can be used with embodiments of the system 10. As shown in FIG. 2, the ZigBee radio 16 may include a processor 17, a transceiver 18 (or separate transmitter and receiver), an antenna 19, and a direct sequence spread spectrum (DSSS) control 21. Returning to FIG. 1, the base station 13 includes a radio 28 that communicates with the radio 16. The radio 28 may also be a micro-power radio, preferably one based on the IEEE 802.15.4. In certain aspects, the radio 28 may be a ZigBee radio, for example, having a structure similar to the one shown for radio 16 in FIG. 2. The radio 28 may receive power through the power input connection 37 of the base station 13.

A radio 34 may be provided between the client device 12 and the base station 13 to act as a repeater. In certain aspects, the radio 34 may be a micro-power radio. In certain aspects, the radio 34 may be based on IEEE 802.15.4 protocol. In certain aspects, the radio 34 may be a ZigBee radio implementing the IEEE 802.15.4 protocol. In a general mode, data is transmitted between the radio 16 of the client device 12 and the radio 28 of the base station 13. In a repeater mode, data is transmitted between the radio 16 of the client device 12 and the repeater radio 34 and between the repeater radio 34 and the base station 13. The radio 34 may be provided with a power input connection 35 to allow for an external supply of power. Typically, the system 10 operates in the general mode and reserves the repeater mode for backup purposes.

In addition to the radio 28, the base station 13 may have a processor 38 and memory 40. Memory 40 may be used to store data received through the radio 28, while the processor 38 may control operation of the base station 13, e.g., coordinating storage of data into memory 40 after receiving the data through the radio 28. The base station 13 makes the data received from the client device 12 available to a control and acquisition system 42 through a network link 44, which may be wired or wireless. The base station 13 may include an Ethernet interface 45 for connection to the network link 44. The control and acquisition system 42 may include processor 46, memory 47, display device 48, and other peripheral devices as needed for observing the data received from the base station 13.

The following are examples of systems for monitoring a drilling rig operation. The following examples are not intended to limit use of the wireless transmission system as otherwise described above.

Example 1

Figure 3:
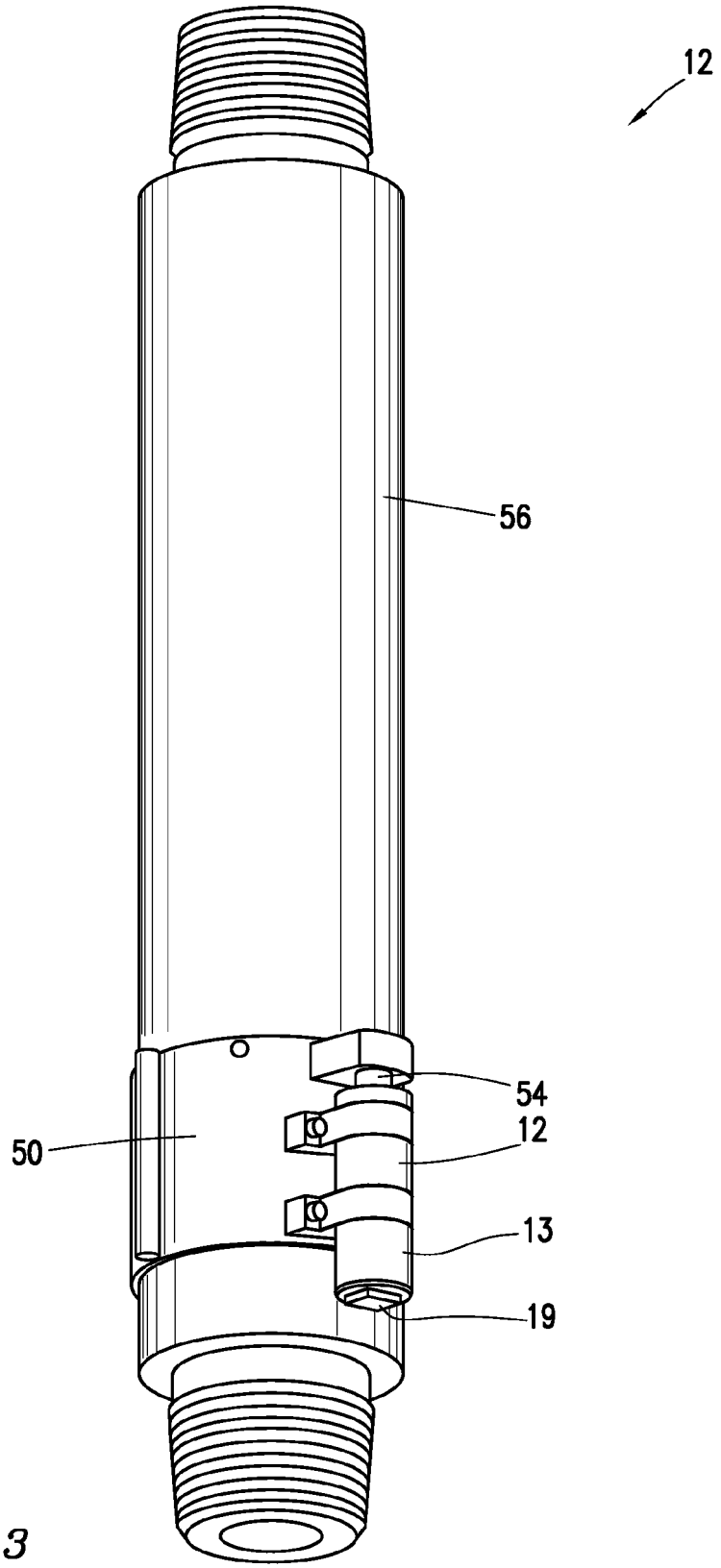
FIG. 3 is a perspective view of the client device of the wireless transmission system of FIG. 1 mounted on an instrumented sub.

FIG. 3 shows the client device 12 mounted on an instrumented sub 56. A cover 50 protects the sensors attached to the instrumented sub 56. A housing 13 containing the components of the client device 12 is fastened to the cover 50. Any suitable means of fastening the housing 13 to the cover 50 may be used. The antenna 19 of the radio (16 in FIG. 2) of the client device 12 is shown as a patch-type antenna. The housing 13 is of a construction suitable for the environment of operation. The housing 13 should generally be rugged, able to withstand high temperatures, and provide a sealed environment for the components contained therein. An electrical connector 54 is provided on the cover 50 for connecting the sensor inputs to the client device 12. The electrical connector 54 may be removable to allow access into the interior of the housing 13, e.g., to allow the battery of the client device 12 to be easily replaced.

Example 2

Figure 4:
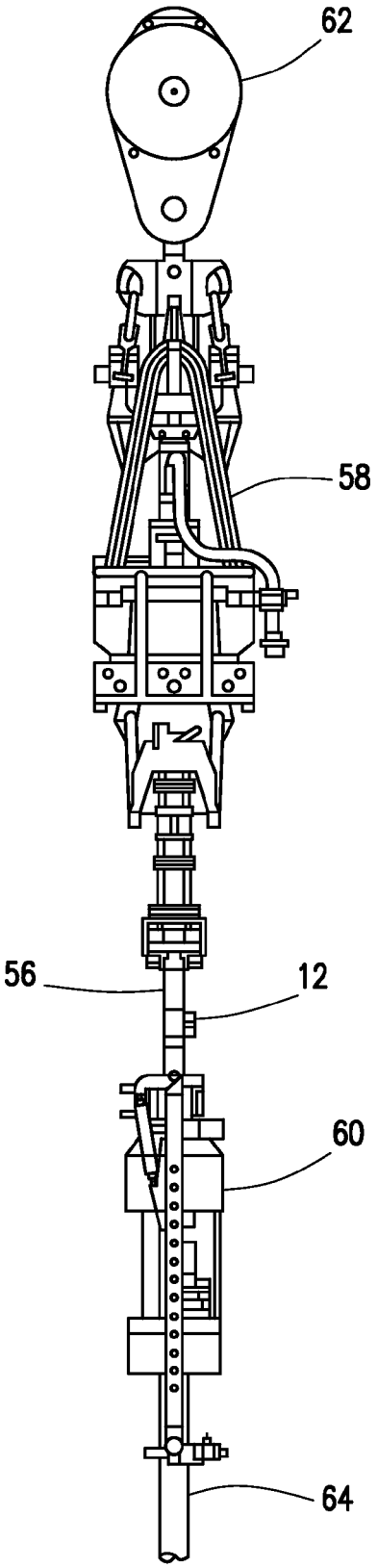
FIG. 4 shows the instrumented sub and client device of FIG. 3 located between a top drive assembly and a pipe running tool.

FIG. 4 shows a system for monitoring transmitted torque in a pipe running tool. In this figure, the instrumented sub 56 of Example 1 connects a top drive assembly 58, hung on a traveling block 62, to a pipe running tool 60. The pipe running tool 60 is designed to assemble pipe strings and includes a pipe engagement assembly (not indicated separately) for engaging a pipe segment 64. The instrumented sub 56 may include strain gauges and other hardware to measure torque transmitted through the shaft of the top drive assembly 58 to the pipe running tool 60. The signals from the instrumented sub 56 are transferred to the client device 12, where they are processed and then sent wirelessly to the base station (13 in FIG. 1) and then on to the control and acquisition system (42 in FIG. 1). The connection for transferring the signals between the instrumented sub 56 and the client device 12 may be an electrical connector (e.g., 54 in FIG. 3), a cable, or any electrical contact device suitable for the environment. The signals collected by the data acquisition device (14 in FIG. 1) of the client device 12 are processed and then transmitted to the base station (13 in FIG. 1), which transmits the signals to the control and acquisition system (42 in FIG. 1). The instrumented sub 56 could be instrumented to read other imposed loads besides torque, such as tension loads and bending loads.

Example 3

Still referring to FIG. 4, the gyroscope (29 in FIG. 1) of the client device 12 measures angular velocity as the pipe running tool 60 rotates. The data acquisition device (14 in FIG. 1) of the client device 12 collects the signals from the gyroscope, processes the signals, and sends the signals wirelessly to the base station (13 in FIG. 1), which then sends the signals to the control and acquisition system (42 in FIG. 1). The signals are integrated to obtain the rotational position of the pipe running tool 60. While the rotational position of the pipe running tool 60 is being measured, the torque applied to the pipe running tool 60 is also measured as in Example 2. The rotational position and the torque information are used to determine the proper makeup of pipe threaded connections. In this example, the gyroscope (29 in FIG. 1) of the client device 12 provides an easy way of measuring pipe connection turns. Alternative devices that can be used to measure pipe connection turns include rotary encoder, proximity switch with target, and any other device that can accurately measure rotational positions. These alternative devices may be used in lieu of, or together with, the gyroscope 29. In one example, a rotary encoder may be used as a backup device to the gyroscope 29. The client device 12 can collect signals from any of these alternate devices and send the signals wirelessly to the control and acquisition system (42 in FIG. 1) via the base station (13 in FIG. 1).

Example 4

This example relates to control of the power usage of the client device 12. Referring to FIG. 1, the gyroscope 29 of the client device 12 assists in controlling the power state of the client device 12 while the client device 12 is coupled to a rotatable member, such as in Examples 1 through 3. The gyroscope 29 outputs a variable signal depending on whether the rotatable member to which the client device 12 is attached is being rotated or not. The signal strength of the gyroscope 29 is used to determine when to power-up or power-down the client device 12. In one implementation, the client device 12 has three power states: a high-power state, a low-power state, and an auto-power state. The high-power state occurs when the gyroscope 29 signal is outside of a predefined threshold band. The low-power state occurs when the gyroscope 29 signal is within the predefined threshold band. The auto-power state is similar to the low-power state but allows the radio 16 to continue to operate in the high-power state for a flexible time period after the gyroscope 29 signal enters the predefined threshold band. The flexible time period can be changed using bidirectional communication between the base station 13 and the client device 12.

Example 5

Figure 5:
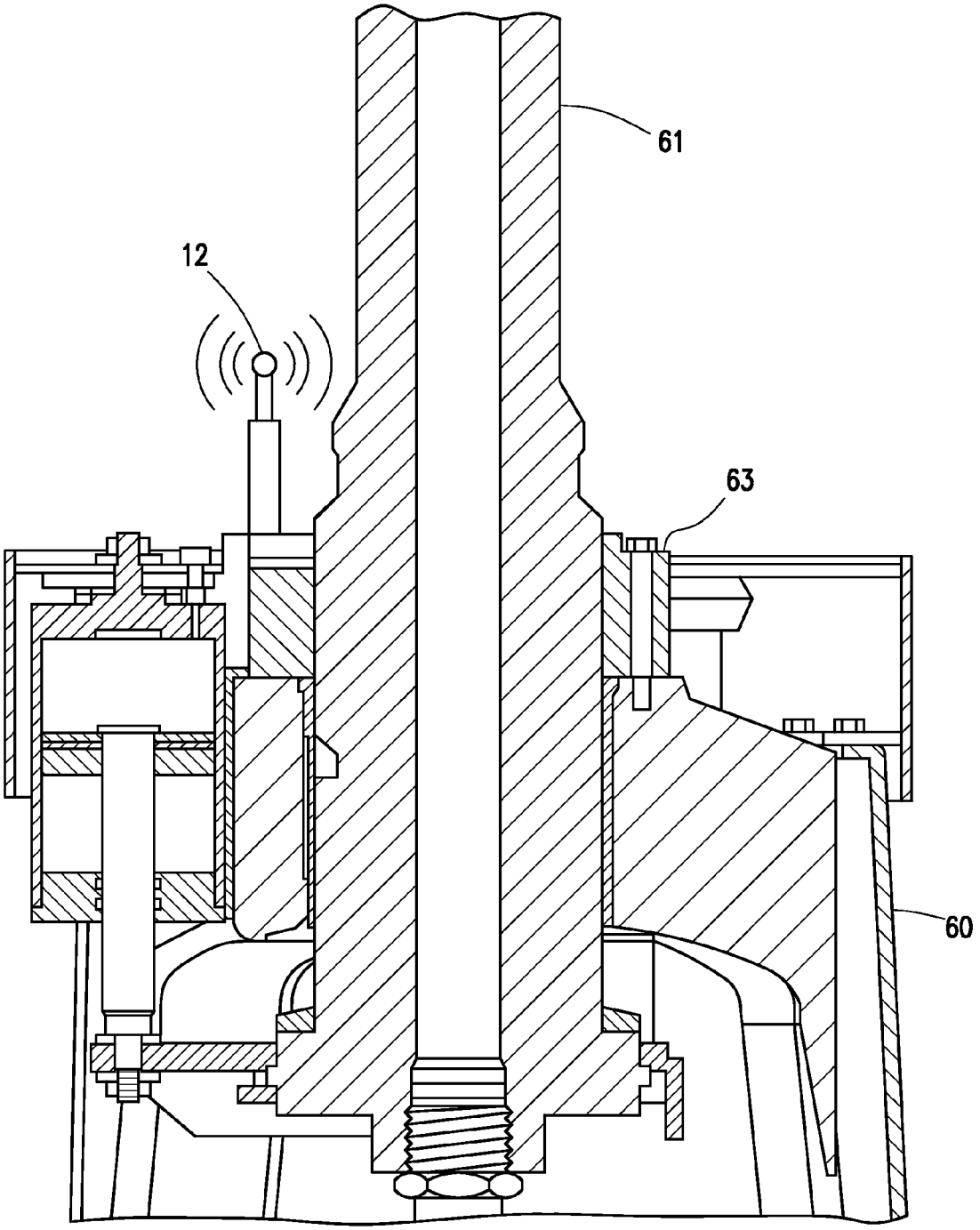
FIG. 5 shows the client device of the wireless transmission system of FIG. 1 mounted on a pipe running tool.

FIG. 5 shows another system for monitoring transmitted torque in the pipe running tool 60 (only the portion of pipe running tool 60 relevant to description of this example is shown). The client device 12 is mounted on the pipe running tool 60 in close proximity to a spline shaft 61 and a spline bushing 63 of the pipe running tool 60. The spline interface between the spline shaft 61 and spline bushing 63 transmits torque. The spline bushing 63 and/or spline shaft 61 are instrumented (e.g., with strain gages) to measure the transmitted torque. The client device 12 is used to collect and transmit the torque measurements wirelessly to the base station (13 in FIG. 1), which in turn transmits the measurements to the control and acquisition system (42 in FIG. 1). Any suitable connection between the client device 12 and the sensors in the spline bushing 63 and/or spline shaft 61 to allow transfer of signals between the sensors and the client device 12 may be used.

Example 6

In this example, the client device (12 in FIG. 1) is mechanically coupled to a rotatable member and data collected by sensors in the client device is used to derive information other than what the sensors were originally designed for. Specifically, data collected from a 3-axis accelerometer is used to both determine an inclination angle and a rotational angle of a top drive link. The inclination angle depends on gravity, but the rotational angle does not depend on gravity. Top drive links are used to suspend an elevator from a top drive (see, e.g., FIG. 8 of U.S. Pat. No. 4,489,794, issued to Boyadjieff). The elevator is provided to support a drill pipe. A link tilt mechanism is coupled to the top drive links to selectively tilt the top drive links and the suspended elevator, e.g., in order to position the elevator over a mousehole.

Figure 6:
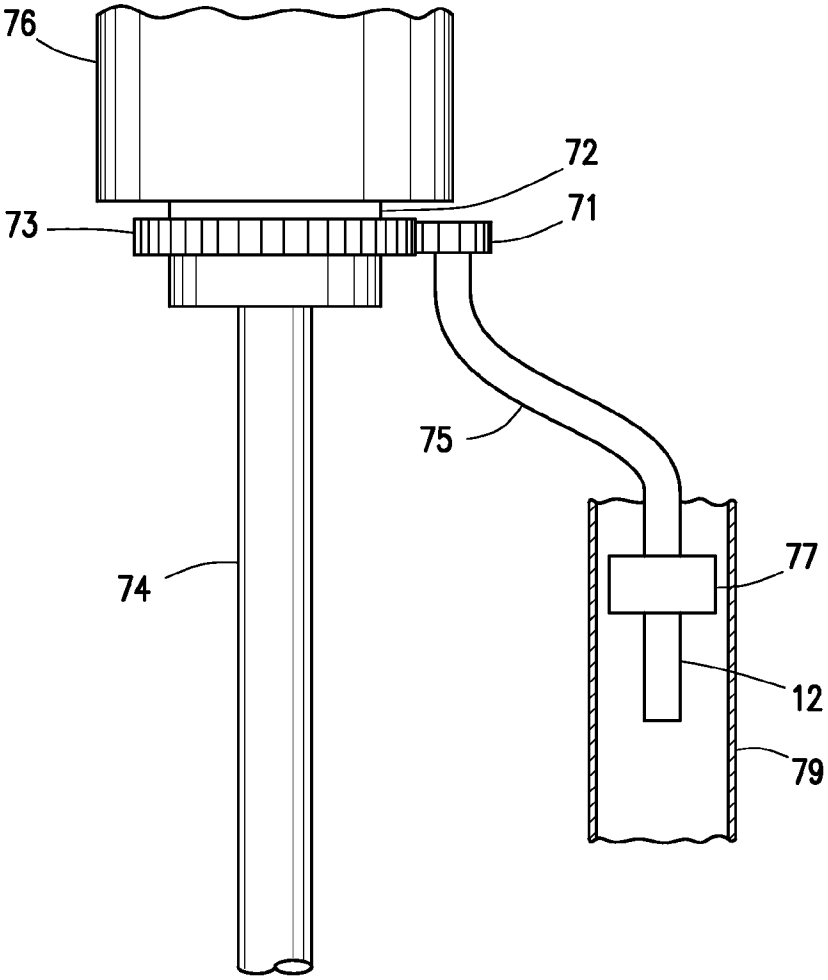
FIG. 6 shows a system for monitoring inclination and rotational angles of a top drive link tilt.

The monitoring setup is shown in FIG. 6. In this figure, a pinion gear 71 with mounting hardware meshes with a rotation gear 73 of a top drive pipe handler 72. The top drive pipe handler 72 is connected to the top drive shaft 74 of the top drive 76. The pinion gear 71 is attached to a flexible cable 75 that transmits rotary motion of the pinion gear 71 to a gear box assembly 77, which is mounted to a link tilt 79. The small box assembly 77 contains a gearbox reduction configured as the reciprocal of the pinion gear 71 and rotation gear 73 ratio. A "gear ratio" is the relationship between the numbers of teeth on two gears that are meshed. The client device 12 is attached to the output of the gearbox reduction 77. The 3-axis accelerometer (27 in FIG. 1), which is a member of the client device 12, will have the same angle as the link tilt 79. The 3-axis accelerometer will rotate about one of its axes once per revolution of the top drive pipe handler. The changing accelerometer signals allow for determination of inclination angle and rotational angle of the link tilt 79. The data acquisition device is configured to extract the inclination and rotational angles from the 3-axis accelerometer data.

In the example above, if the client device 12 is equipped with three 3-axis accelerometers for redundant tilt angle and rotational angle sensing of top drive link tilts, then, should one accelerometer fail, a warning can be issued to schedule maintenance/repair of the device while there are still two remaining accelerometers for data integrity checking and successful collision avoidance monitoring.

Example 7

Figure 7:
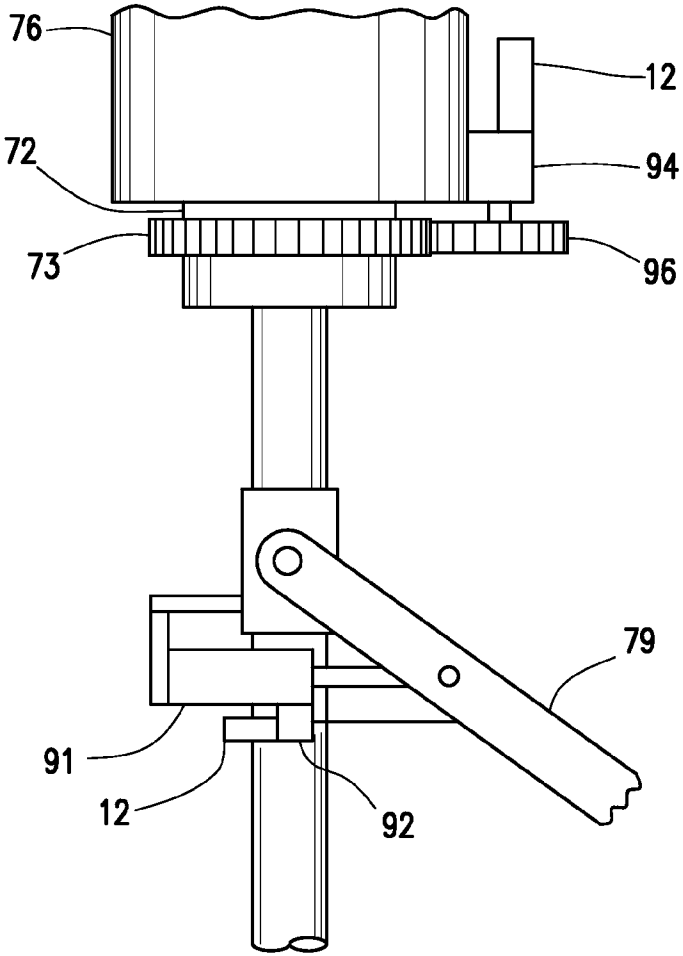
FIG. 7 shows a system for monitoring inclination angle or rotational angle of a top drive link tilt.

Referring to FIG. 7, instead of using an accelerometer as described in Example 6 to measure inclination angle, a power cylinder 91 (such as a hydraulic or pneumatic cylinder) is used. The power cylinder 91 is mechanically coupled to the link tilt arm 79 and instrumented with a stroke measuring instrument 92, e.g. a string potentiometer or other type of linear transducer. As the link tilt arm 79 changes angle, the power cylinder 91 strokes in and out, thus changing the signal generated by the stroke measuring instrument 92. The client device 12 is connected to the stroke measuring instrument 92 to collect the signals or data generated by the stroke measuring instrument 92.

Example 8

Instead of using an accelerometer to measure rotational angle, as described in Example 6, a rotary encoder may be used. Referring to FIG. 7, the rotary encoder 94 is coupled to an encoder drive gear 96, which meshes with the rotation gear 73 of the top drive pipe handler 72. The client device 12 is connected to the rotary encoder 94 to collect the signals or data generated by the rotary encoder 94.

Returning to FIG. 1, the client device 12 provides a very reliable means of transmitting data from sensors located on a rotating member, e.g., casing or pipe running tool or top drive shaft, or a non-rotating member to the base station 13, where the data can then be made available for communication over a network to a control and acquisition system 42. The data acquisition device 14 has a generic and flexible configuration to allow its use in multiple applications and with various data signals. The client device 12 is of rugged configuration and designed for use in the hazardous oilfield environment.

Multi-Level Wellsite Monitoring System

The disclosure also relates to a multi-level wellsite monitoring system for sensing wellsite parameters and communicating about the wellsite. The monitoring system includes a one or more client devices with sensors to measure wellsite parameters and radios to communicate. The client devices may be positioned at various locations about the wellsite (e.g., as shown in FIGS. 1-7), and communicate with other client devices. The client device may be used as a source to gather measurements, a repeater to convey communications between locations, and/or as a base station to offload to a control system (e.g., control data acquisition of FIG. 1 or surface unit). The system may be used to acquire data from the wellsite and transfer the data to the control system to make intelligent decisions regarding the wellsite operation. The system may be used to convey data around various obstacles (e.g., large steel structures in the rig environment) and to various locations via one or more of the client devices. The system may be assembled in various configurations and readjusted as needed using modular connections.

The modular system may be used to provide flexibility to address various wellsite configurations, to pair with existing sensors, to circumvent obstacles, and/or to include desired components. The multi-level radio communications may also be used to minimize latency by providing simultaneous communications, reduce interference by locating optimal communication routes, flexible configurations by creating networks as needed, reduce costs by allowing selective shut off and activation, increase transmission speeds (e.g., by simultaneous receiving and sending), utilize existing systems by piggy-backing wellsite sensors to the client devices, and amplify transmissions using repeaters.

Figure 8:
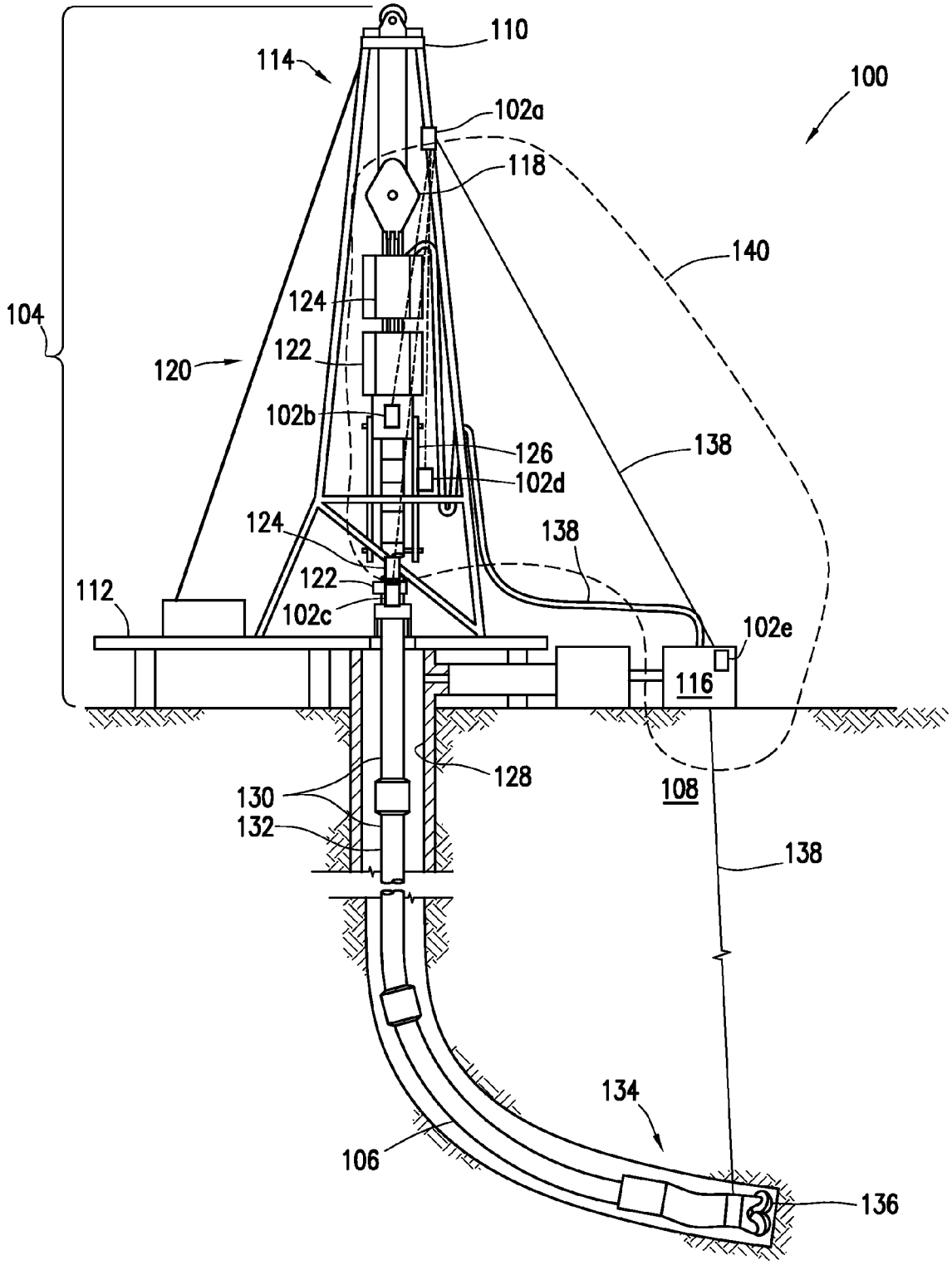
FIG. 8 is a schematic diagram of a wellsite having a wellsite monitoring system including a client device.
Figure 9:
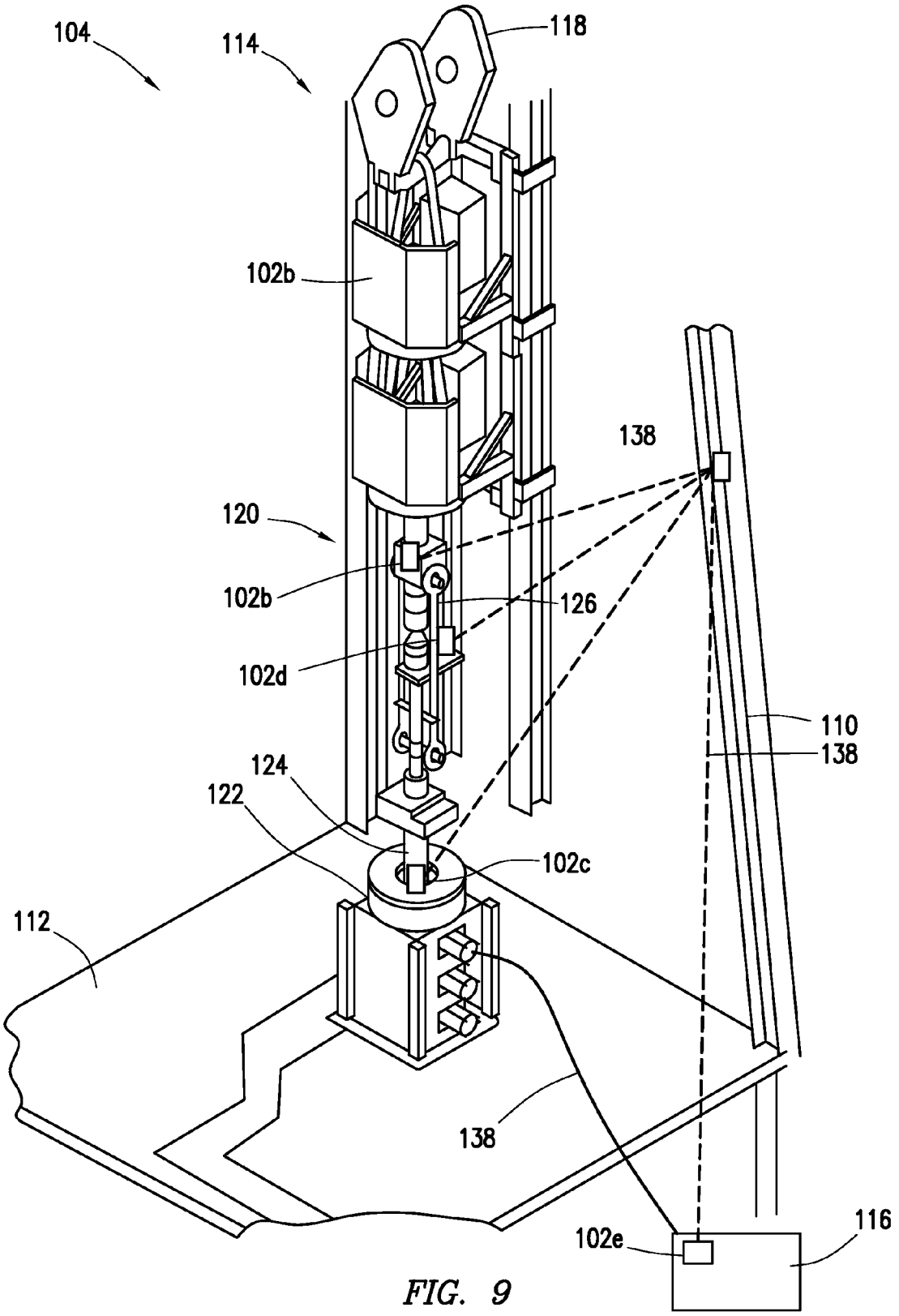
FIG. 9 is a schematic diagram of a portion of the wellsite of FIG. 8.

FIG. 8 shows an example wellsite 100 with client devices 102*a-e* positioned at various locations. The wellsite 100 includes a surface system 104, and a downhole tool 106 deployed into a formation 108. FIG. 9 shows a portion of the wellsite 100 depicting the surface assembly 104 in greater detail. As shown in FIGS. 8 and 9, the surface system 104 includes a rig 110 positioned on a platform 112, a top drive unit 114, and a surface unit 116. The rig 110 is positioned on the platform 112 with the top drive unit 114 suspended therefrom.

The top drive unit 114 includes a traveling block 118, a top drive assembly 120, and a pipe handling tool 122. The traveling block 118 may be used to movably support the top drive 120. The top drive assembly 120 may be similar to the top drive assembly of FIG. 1. The pipe handling tool 122 is suspended via a sub 124 by the top drive assembly 120. Link arm 126 may be positioned about the top drive assembly 120 and/or pipe handling tool 122 and extendable therefrom. Other devices may be positioned about the surface system 104, such as elevators, swivels, hooks, and other tools commonly used on a rig at a wellsite.

The downhole tool 106 is supported below the pipe handling tool 122 and extends into a wellbore 128. The downhole tool 106 as shown is a drilling tool extended into the wellbore by adding stands of pipe 130 in series to form a drill string 132. A downhole end of the downhole tool 106 includes a bottom hole assembly 134 and a bit 136.

The surface system 104 and downhole tool 106 may be operated by the surface unit 116. The surface unit 116 may be wired or wirelessly coupled via one or more communication links 138 to the surface system 104 and/or downhole tool 106 as schematically shown. The surface system 116 may have a switch, controller, processor, display, transceiver, input/output device, battery, and/or other devices capable of providing power, communication, and/or control capabilities for automatically and/or manually operating various portions of the wellsite 100. The surface system 116 may be, for example, similar to the control and acquisition system of FIG. 1.

The wellsite 100 is also shown as having multiple client devices 102*a-e* positioned at various locations to form a monitoring system 140. The client devices 102*a-e* may be positioned to facilitate monitoring of the wellsite 100. The client devices 102*a-e* may be positioned at various locations to measure various wellsite parameters, such as torque, vibration, weight on bit, position and/or movement of various equipment, and/or other parameters. For example, client device 102*a* is positioned on the rig 110 (e.g., to measure vibration), client device 102*b* is positioned on the top drive assembly 120 (e.g., to measure angle of rotation of a rotating head of a top drive rotating link), client device 102*c* is positioned on the sub 124 above the pipe handling tool 122

(e.g., to measure tension, torsion, bending, vibration, etc.), client device 102*d* is positioned on link arm 126 (e.g., to measure link inclination angle), and client device 102*e* may be positioned at the surface unit 116 (e.g., to communicate with the other client devices 102*a-d*) and surface unit 116.

One or more client devices 102*a-e* may be positioned at various locations as needed. One or more of the client devices 102*a-e* may act in various roles, such as a source to obtain measurements, as a repeater to convey communications between locations, and/or as a base station to offload collected data and/or upload instructions. In an example, client device 102*b* on the top drive may act as a source to measure parameters, such as weight on bit and torque. In another example, the client device 102*e* may be linked via a communication link (e.g., a hard wire) to the surface unit 116 and/or driller's cabin to act as a base station. In yet another example, the client device 102*a* may be positioned on a fixed structure (e.g., rig 110) in a line of sight with another client device 102*b-e* and/or the base station at surface 116 to act as a repeater.

Each client device 102*a-e* may act as a serial interface in the monitoring system 140. This allows the client devices 102*a-e* to assume roles as a source to collect data, a repeater to convey data, and/or base station to interface directly with the surface unit 116. This serial interface allows the client devices 102*a-e* to connect to a network of external sensors (e.g., 26 of FIG. 1), and to be removably mounted to various equipment at the wellsite 100 (e.g., the top drive) for communication with the surface unit 116.

In a given example, an instrumented sub (e.g., 56 of FIG. 3) may be placed in-between the top drive assembly 58 and the pipe 64 as shown in FIG. 4. The client device 12 is mounted to the instrumented sub as shown in FIG. 3 (or as 102*c* in FIG. 9). The client device 102*c* may be coupled by a connector to the instrument sub to pass data back and forth between the sub and the client device 102*c*. The source client device 102*c* may communicate with the base station client device (102*e*) and/or repeater client devices (e.g., 102*a*). The repeater client devices 102*a* can be located anywhere on the rig (e.g., wherever gives the best chance for successful wireless communication). This may be on the derrick structure, or some other stationary structure. The base station client device 102*e* may be located, for example, near the dog-house or driller's cabin for communication therewith.

Figure 10:
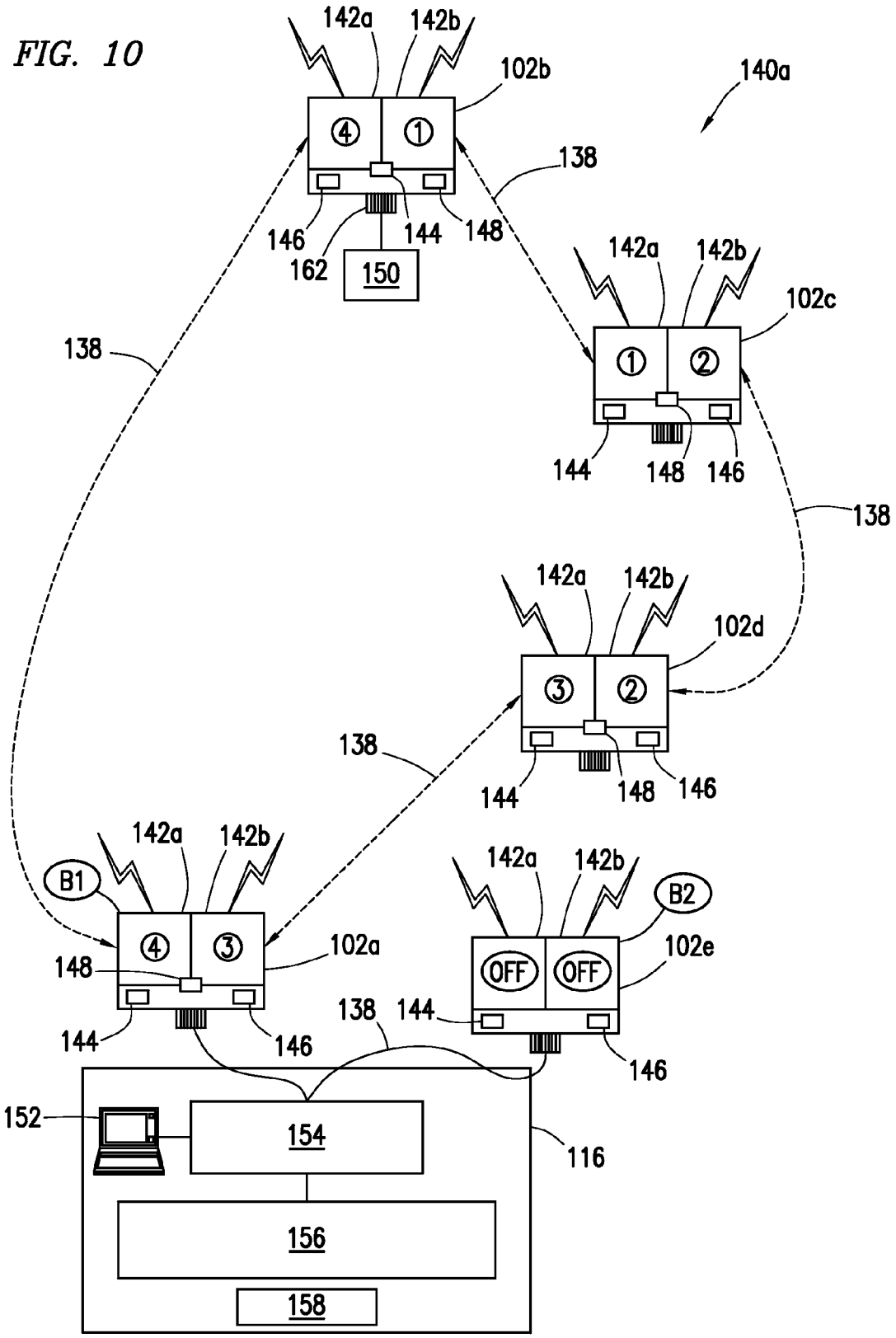
FIG. 10 is a schematic diagram depicting the wellsite monitoring system.
Figure 11:
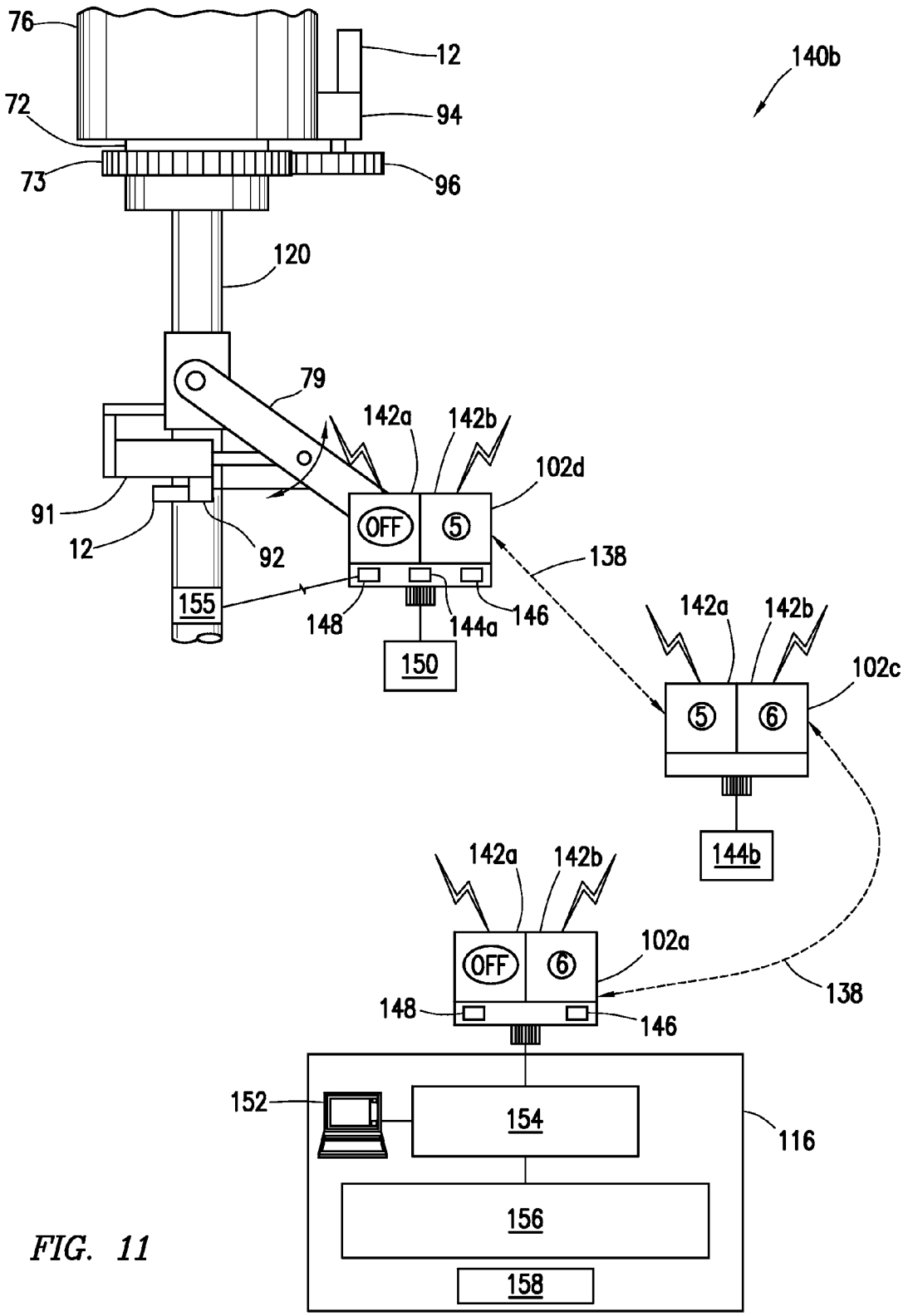
FIG. 11 is a schematic diagram of the wellsite monitoring system about the top drive link.
Figure 12:
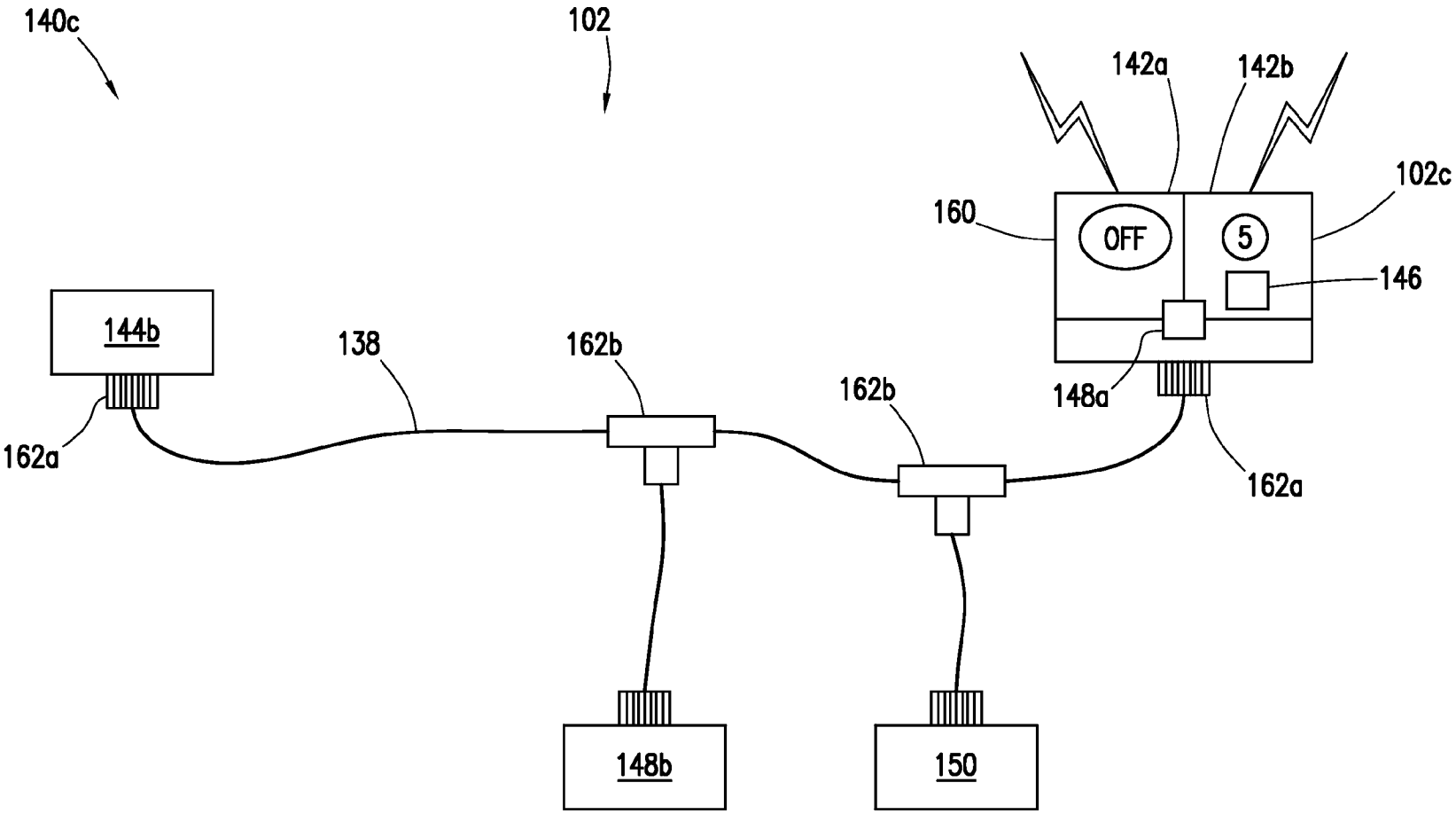
FIG. 12 is a schematic diagram of a monitoring unit of the wellsite monitoring system.

FIGS. 10-12 show various configurations of the monitoring system 140*a-c*. As shown in FIG. 10, the monitoring system 140*a* includes the client devices 102*a-e* coupled by communication links 138 to surface unit 116. The client devices 102*a-e* are shown in an example configuration and may be similar to and/or contain features of other client devices described herein (e.g., 12 of FIG. 1).

Each of the client devices 102*a-e* includes multiple radios 142*a,b*, power supply (e.g., battery) 144, and electronics 146. Optionally, one or more of the client devices may be provided with other features, such as a sensor 148, an encoder 150, serial interface, power management, memory, data acquisition (DAQ), etc. One or more sensors 148, such as gyros, accelerometers, magnetometers, gauges (e.g., strain, temperature, etc.), Hall effect sensors, and/or other devices, may be provided in the client devices to measure wellsite parameters.

In the example shown in FIG. 10, the client devices 102*a-e* each have two radios 142*a,b* set at radio channels for communication with another client device. Client device 102*a* (positioned on the rig 110 in FIGS. 1 and 2) is treated as a first base station B1 which couples to client devices 102*b* and 102*d*. The radio channels of each client device 102*a-e* are aligned so that radio 142*a* of each client device is set at the same radio channel as the radio 142*b* of one other client device, thereby forming a chain of communication between the client devices.

As shown, the client devices 102*b* and 102*d* are each coupled to client device 102*a* and 102*c* to form a communication loop. To provide communication about the loop, client device 102*a* has radio 142*a* set at radio channel 4 for communication with radio 142*a* of client device 102*b* and radio 142*b* set at radio channel 3 for communication with radio 142*a* of client device 102*d*, and the client device 102*c* has radio 142*a* set at channel 1 for communication with radio 142*b* of client device 102*b*, radio 142*b* set at radio channel 2 for communication with radio 142*a* of client device 102*d*.

Various combinations of radio channels may be provided with an amplifier that may be toggled on/off to provide communication as desired between one or more of the client devices and the base station(s) B1, B2. Radios assigned to the same radio channel are able to communicate with each other. Each client device may be configured with the radios paired to communicate with select other radios of other client devices. Each client device has multiple radios to allow communication between multiple client devices. Each radio can be assigned a unique radio channel (e.g., a band of frequency of about 2.4 GHz). Each radio may have up to twenty five or more available radio channels for each radio.

Base station B1 is coupled to the surface unit 116 and another client device 102*e* at the surface unit 116. The client device 102*e* acts as a second base station B2 for communication with the surface unit 116. The surface unit 116 includes a processor 152, network switch 154, controller 156, electronics 158, and other optional devices to communicate with the client devices 102*a-e* (see, e.g., 42 of FIG. 1). The surface unit 116 may send power, communication, and/or control signals to the client devices 102*a-e* and/or receive data therefrom. Various combinations of the surface unit 116 and/or the control and acquisition unit of FIG. 1 may be used as part, or all, of the surface unit 116 or may be coupled thereto.

In operation, the source client device 102*b* may be attached to the wellsite (e.g., at the top drive on the rotating link adaptor as shown in FIG. 9 or in an instrumented sub, such as 56 of FIGS. 3-4). The encoder 150 may be attached to the client device 102*b* via a connector 162 (e.g., serial connector RS485) to receive encoder data (e.g., providing the position of the rotating head). The source client device 102*b* may also collect data via internal sensors (e.g., accelerometer, gyro, etc.) Radio 142*a* of the source client device 102*b* may try to communicate directly with radio 142*a* of base station client device 102*a* (B1) to pass the acquired data via radio channel 4.

If this path is obstructed (e.g., by large metal structures), radio 142*b* of source client device 102*b* may communicate with radio 102*a* of repeater client device 102*c* on radio channel 1. Data received by radio 142*a* of repeater client device 102*c* can be transmitted to radio 142*b* of repeater client device 102*b* via radio channel 2. This allows radio 142*a* of repeater client device 102*c* to be listening and receiving more data from source client device 102*b* while also transmitting with client device 102*d*. Second repeater client device 102*d* communicates in the same way to receive data from first repeater client device 102*c* via radio channel 2 while transmitting via radio channel 3 to base station client device 102*a*. Multiple radios may be paired to allow communication between client devices as needed to circumvent obstacles, reach destinations, provide simultaneous communication, and reduce latency (or delay) of data transmission. In some cases, wireless transfer rates (e.g., universal asynchronous receiver/transmitter UART) may be slower than chip-to-chip data transfer rates (e.g., SPI, C2C).

Once the data reaches the base station (B1), it may pass through a network switch 154 to a control system 156 for processing. The network switch 154 may be used to allow for multiple base stations (B1, B2 . . . ) to be connected to the control system 156, and for the control system to be able to select which base station it wants to communicate with. In some applications, multiple base stations may be needed to handle all of the data from a large number of client devices and/or other sources. The processing unit 152 may be provided with logic to perform additional functions, such as scheduling between the control system and the base stations.

Each client device 102*a-e* may be provided with multiple sensors 148 (e.g., four hall-effect proximity sensors), one for each face of the client device. These sensors 148 may be used to detect the presence of a magnetic field. The output of the sensors 148 may be used to change the state of the client device (e.g., in the same way as the accelerometer (27), gyro (29), or other sensors (26) of FIG. 1). This may be used to allow the sensors 148 to detect a condition and activate the client device 102 to turn on/off communications. When measuring inclination angle using accelerometers, inclination angle may be measured independent of the initial three-dimensional orientation of the accelerometer. Also, the inclination angle can be zeroed at any time, again independent of the 3D orientation of the accelerometer.

FIG. 11 shows another view of the monitoring system 140*b* used to monitor movement of the link tilt 79 of FIG. 7 (which may be similar to the link arm 126 of FIGS. 8 and 9). As indicated by FIG. 7, the client device 12 may be positioned at various locations. As shown in the example of FIG. 11, the client device 102*d* is positioned on the link tilt 79 to monitor movement and determine angular position.

As also shown in this example, client device 102*d* acts as a source to measure parameters, such as angle of the tilt link 79, client device 102*c* acts as a repeater, and client device 102*a* is coupled to the surface unit 116 to act as the base unit. The client device 102*d* uses an internal sensor 148 (e.g., Hall effect proximity switch) and (e.g., encoder) to sense the presence of an identifier (e.g., magnet) 155 located on the top drive assembly 120. The client devices 102*c* may have a battery power supply 144*a* or a hard wired power supply 144*b* and other electronics 146.

The radio 142*a* of the client device 102*d* is in the off position and the radio 142*b* is set at radio channel 5 for communication with radio 142*a* of client device 102*c*. Radio 142*b* of client device 102*c* is set at radio channel 6 for communication with 142*b* of client device 102*a*. Radio 142*a* of client device 102*a* is in the off position. Data collected by the client device 102*d* may be passed via repeater client device 102*c* to the base station client device 102*a*. Data may be downloaded from client device 102*a* to the surface unit 116. Optionally, the radios of client device 102*a* may be linked to client device 102*d* to complete the communication loop.

As shown by this example, the client device 102*d* may be set to constantly monitor the link tilt 79, or be selectively activated to begin transmissions. Optionally, when the link tilt 79 is retracted, battery life may be conserved by moving to an off position and terminating transmission of costly data updates. Data collection/transmission may be activated by the sensor 148 to start/stop transmission, or enter into some other state (e.g., acquire data, start a different software routine, perform a fast Fourier transform, etc.)

For example, the magnet 155 on the top drive assembly 120 may act as a proximity switch to signal the client device 102*d* when moved to a given position (e.g., touching the client device 102*d*). When the magnet 155 is within a given range of the client device 102*d*, it may trigger the sensor 148 (e.g., Hall effect sensor) to terminate transmissions with client device 102*c*, and when out of range initiate transmission with client device 102*c*. The sensor 148 may include an accelerometer to change the state of the device (e.g., stop/start radio transmissions). For example, if the angle value has a rate of change that indicates motion, transmission can begin. Absent such change, transmissions may be terminated.

During this monitoring, the measurements may be collected by internal and/or external sensors of the client device. Data may be wirelessly communicated directly from the source client device with the base station, or via a repeater to the base station. The base station may then pass the data along to the control system via a wireless or hard-wired connection.

The configuration of FIG. 12 is shown as having a wireless power supply 144*a*. Due to rotation and movement of the link arm 79, wired power sources may not be feasible. This configuration depicts the power supply in the form of a battery pack 144*a* connected to the client device 102*d*. This external pack 144*a* may be used alone or as a supplement to provide additional battery life to an internal battery. The wireless power supply may be an external pack 144*b* positioned outside of the client device for easy access, with a connector 162*a* provided to allow quick removal of the batteries. The client device may optionally be powered off of an external power supply 144*b* (see also 35 and 37 of FIG. 1) and bypass the internal batteries 144*a* (see also 20 of FIG. 1).

Figure 13:
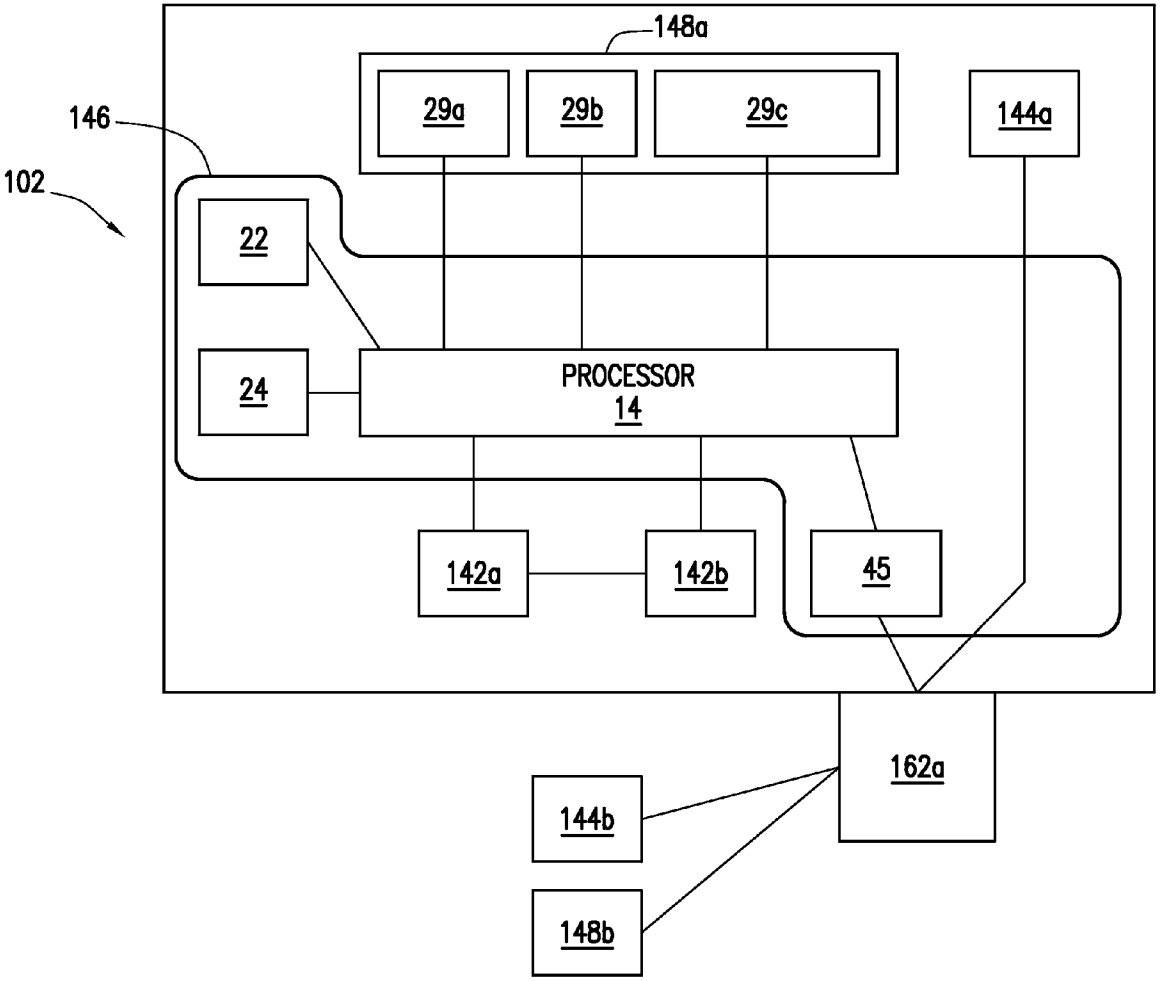
FIG. 13 is an electronics diagram of the sensing unit.
Figure 14B:
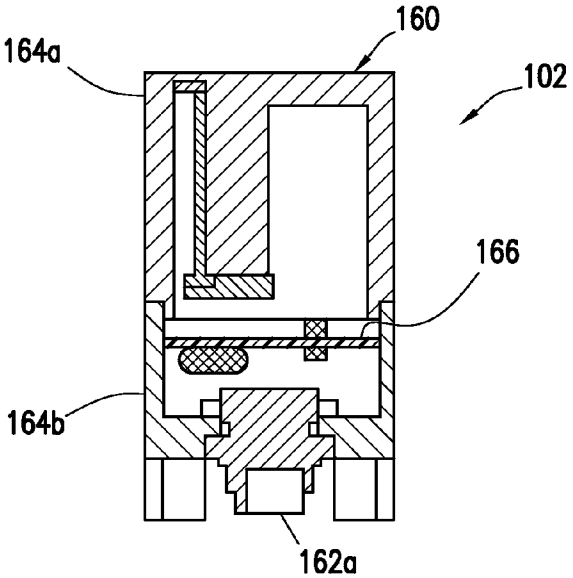
FIGS. 14A-14D are front, end, cross-sectional, and exploded views respectively of the client device.
Figure 14A:
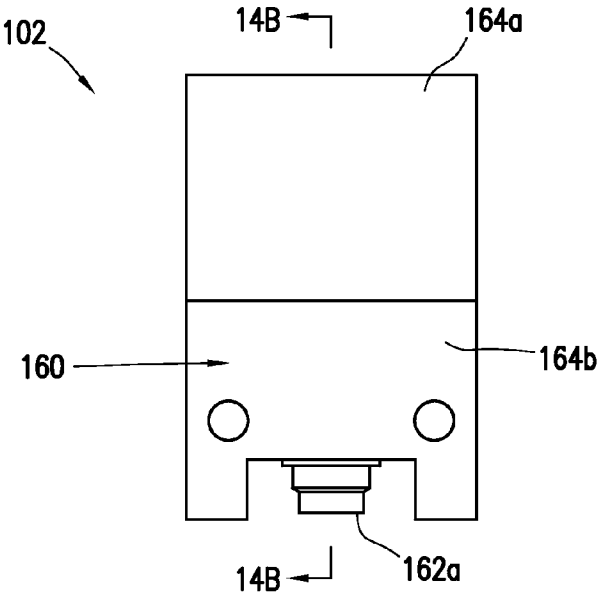
Figure 14C:
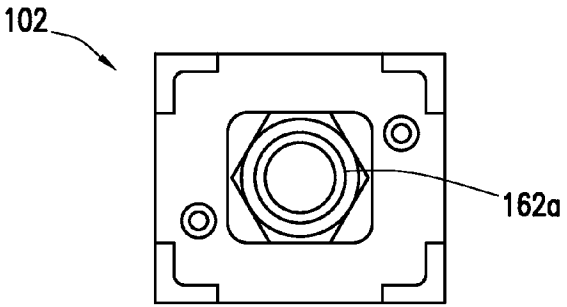
Figure 14D:
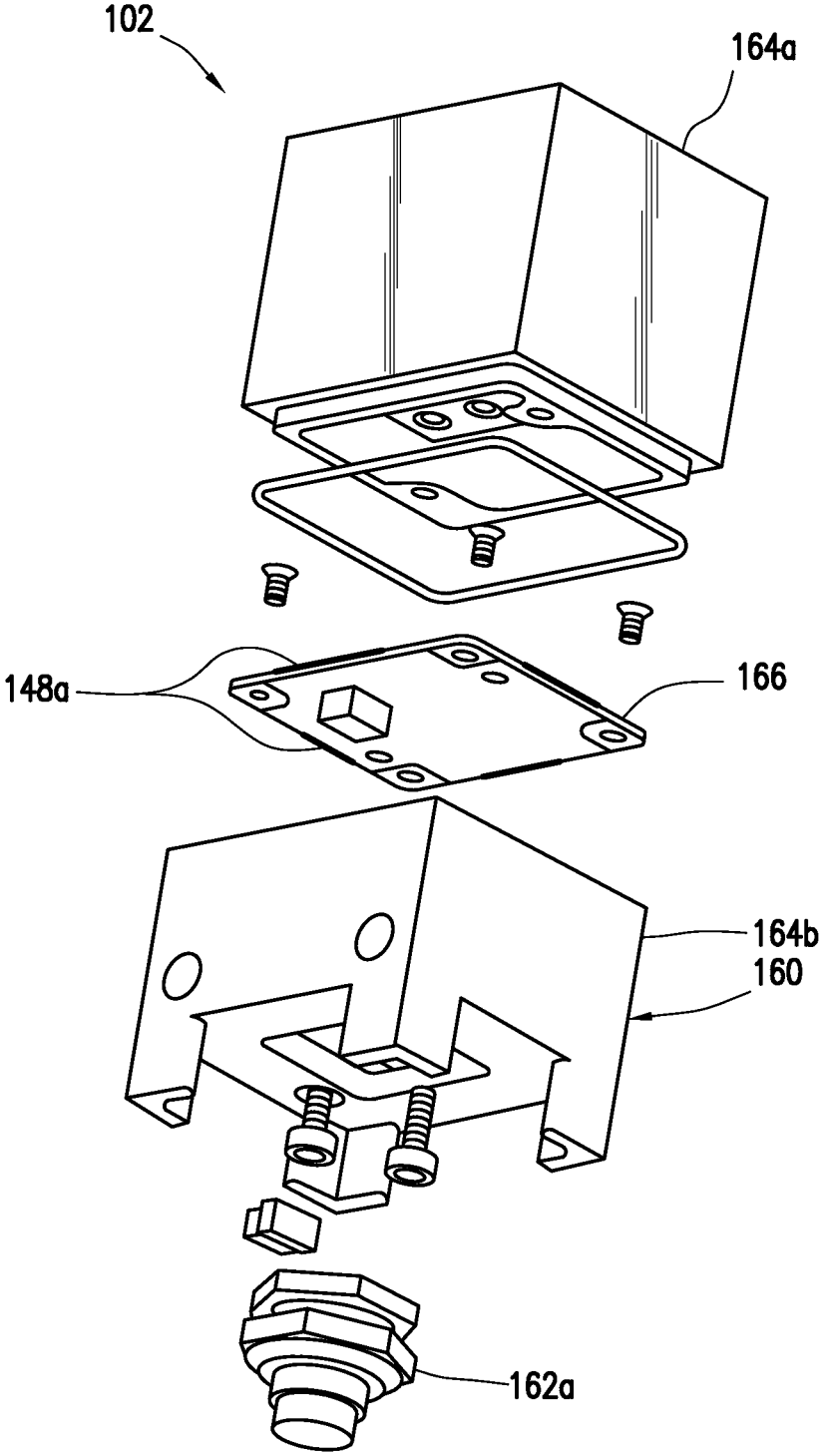

FIGS. 12 and 13 are views of possible configurations of the client device with attachments to form a monitoring unit 102. As shown in these views, the client devices 102 may have a variety of features. FIG. 12 is a schematic view of the components of the client device 102. The components include the radios 142*a,b*, electronics 146, and internal sensors 148*a* mounted in a housing 160 and coupled to the encoder 150, external sensors 148*b*, and power source 144*b*. Other components, such as BUS devices, transceivers, and internal connections may also be provided.

The components may be coupled by a cable 138 with or without connectors 162*a,b*. As shown, the client device 102 is modular, with quick connectors 162*a*, coupling the cable 138 to housing 160 and power source 144, and with T-connectors 162*b* joining portions of the cable 138 to connect the various components. Mating cables or other communication links may be used to attach components of the client devices together via the connectors 162*a,b*. "T" or "H" connectors may be used to attach components of the client device.

The connectors 162*b* may be used to connect various components to the client device to 'piggy-back' onto the monitoring system. For example, battery packs may be coupled to the client device 102 in place of wired systems for use in remote locations or with tools in hazardous locations which may not permit the use of cables to form a communications BUS. In another example, external sensors may be coupled to the client device in parallel with this BUS and encoder 150 using a T or H connector as shown in FIG. 12 to communicate its data via the client device 102.

FIG. 13 is an electronics diagram depicting example components of the client device 102. As shown in this view, the internal power source 144*a* includes batteries, the internal sensors 148*a* include a proximity sensor 29*a*, gyros 29*b*, and accelerometers 29*c*, and the electronics 146 includes a processor 14, power management 20, serial interface 45, memory 24, and DAQ 22 (see FIG. 1). The connector 162*a* connects the electronics to the external power supply 144*b* and the external sensors 148*b*. Other combinations of electronics capable of transmission and/or sensing may be used. Radios 142*a,b* are also included.

FIGS. 14A-D show views of an example configuration of a client device 102. As shown in these example, the client device 102 may include a housing 160, an electronics board (e.g., a printed circuit board, or PCB) 166, and connector 162*a*. The housing 160 includes a base 164*b* with a cap 164*a* connectable thereto. The cap 164*a* may be a radio antenna cap to support the radios for communication about the wellsite without interfering with the signal. A suitable material for the cap may be, for example a plastic. The base 164*b* may be, for example, aluminum, steel, or some other material or composite.

The electronics board 166 is supported in the housing 160 between the base 164*b* and the cap 164*a*. A sensor 148*a* (e.g., Hall effect, proximity sensor, etc.) may be positioned about each edge of the electronics board 166 (e.g., to detect the magnet 155 of FIG. 11). The connector 162*a* is connected to the base 164*b* and coupled to the electrical components on the electronics board 166. The connector 162*a* may be connected to cable 138 for communication with other components, such as encoder 160, external power 144*b*, other sensors 148*b*, and/or other devices as shown in FIG. 12. The client device 102 may be provided with connectors, shields, support, seals, and/or other devices for operation with the various equipment as shown in the various figures herein.

Figure 15:
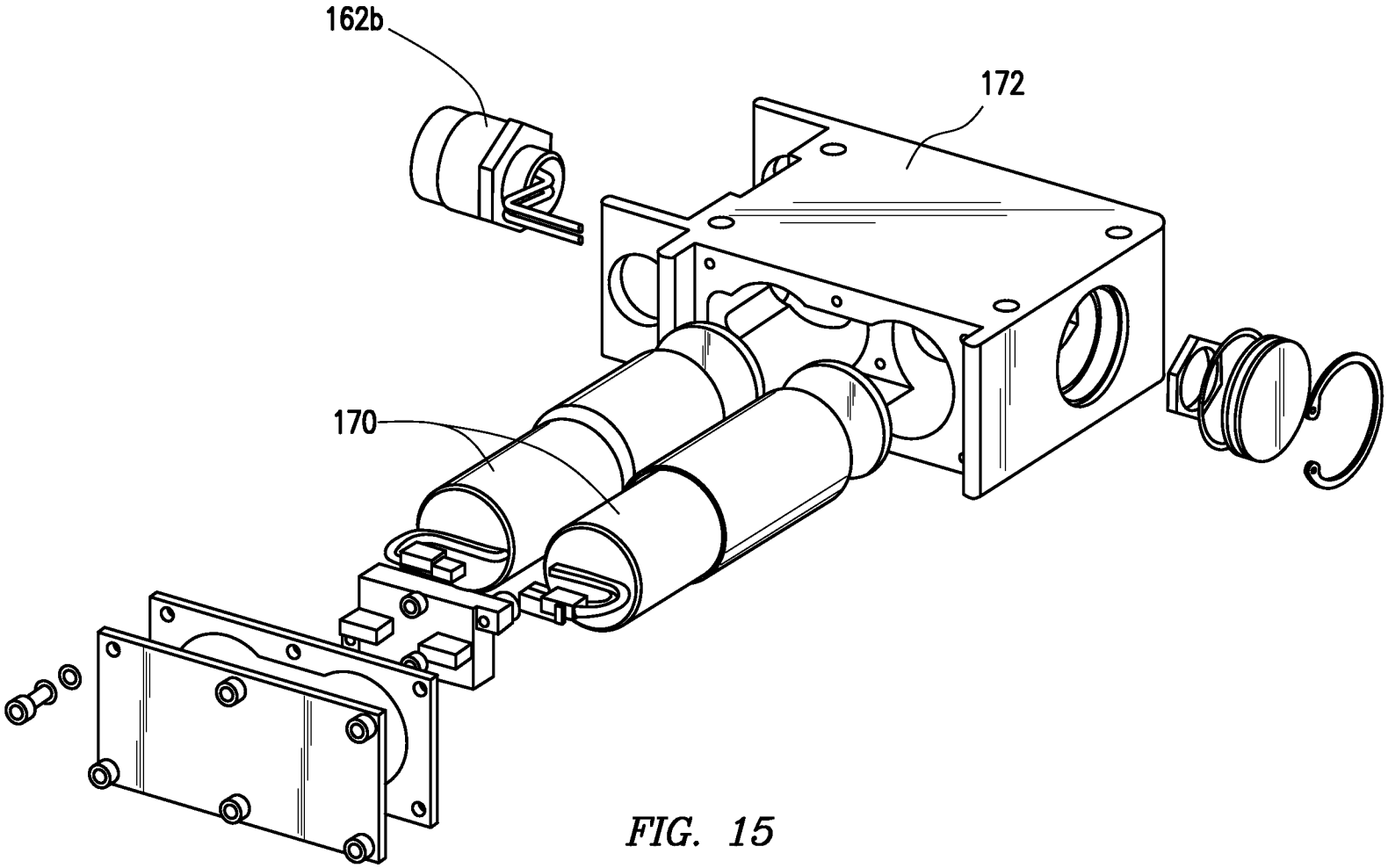
FIG. 15 is an exploded view of a power supply.

FIG. 15 is an exploded view of an example external power supply 144*b* usable with the monitoring system herein. As shown in this example, the external power supply 144*b* includes battery cells 170 positioned in a housing 172 and provided with connectors 162*b* connectable to cable 138 as shown in FIG. 12.

Figure 16:
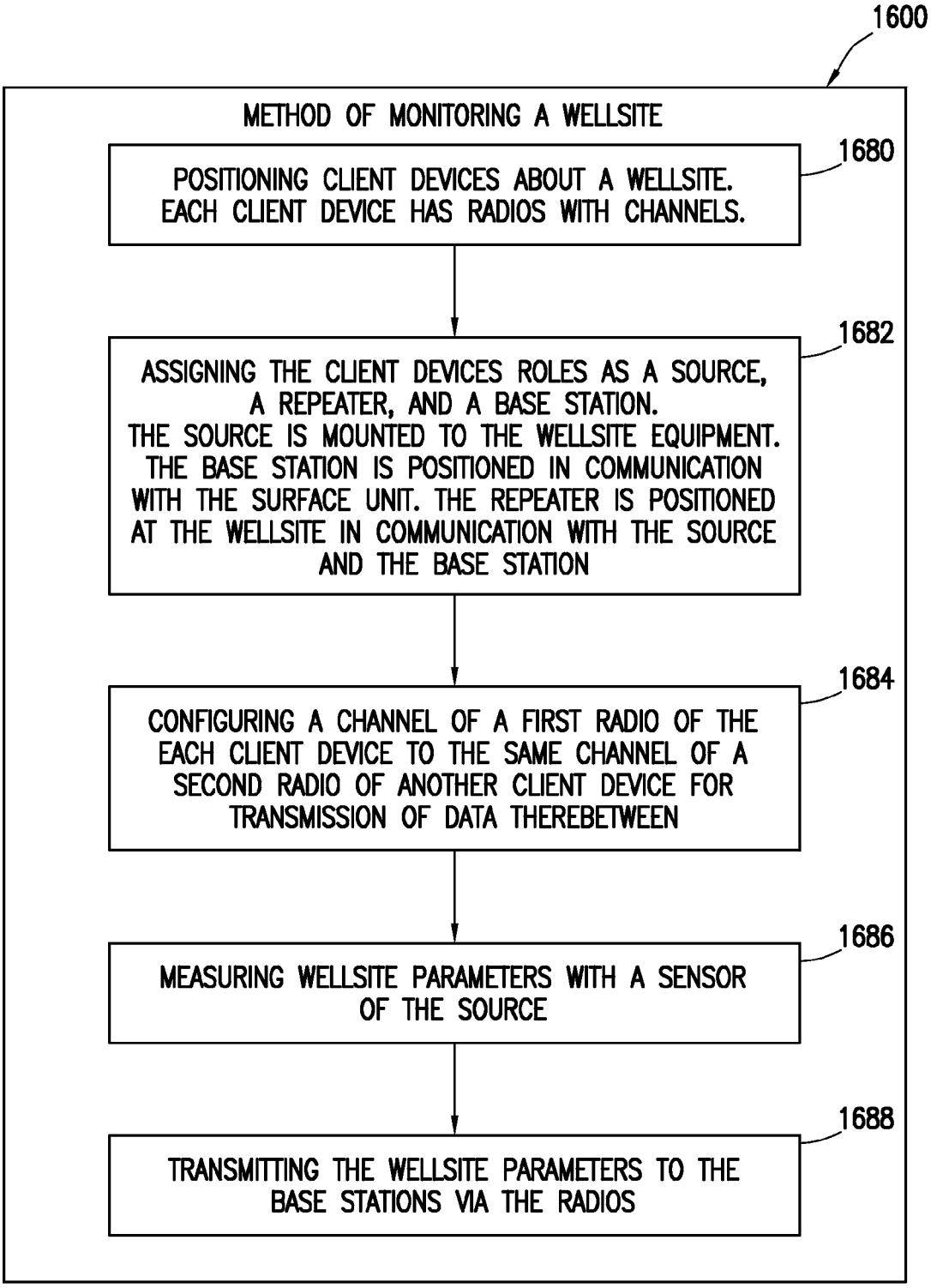
FIG. 16 is a flow chart depicting a method of monitoring a wellsite.

FIG. 16 is a flow chart depicting a method 1600 of monitoring a wellsite. The method 1600 involves 1680 positioning client devices about a wellsite. Each client device has radios with radio channels. The method further involves 1682 assigning the client devices roles as a source, a repeater, and a base station. This assignment can be accomplished through the wireless communication link by uploading code to the memory of the client device. The source is mounted to the wellsite equipment. The base station is positioned in communication with the surface unit. The repeater is positioned at the wellsite in communication with the source and the base station.

The method further involves 1684 configuring a channel (e.g., radio channel) of a first radio of the each client device to the same channel of a second radio of another client device for transmission of data therebetween, 1686 measuring wellsite parameters with a sensor of the source, and 1688 transmitting the wellsite parameters to the base station via the radios. The configuration of radios may be done through the wireless communication link.

The methods may be performed in any order, and repeated as desired.

Among the advantages provided by the disclosed techniques is the real-time communication of signals/data during drilling applications. It will be appreciated by those skilled in the art that the techniques disclosed herein can be implemented for automated/autonomous applications via software configured with algorithms to perform the desired functions. These aspects can be implemented by programming one or more suitable general-purpose computers having appropriate hardware. The programming may be accomplished through the use of one or more program storage devices readable by the processor(s) and encoding one or more programs of instructions executable by the computer for performing the operations described herein. The program storage device may take the form of, e.g., one or more floppy disks; a CD ROM or other optical disk; a read-only memory chip (ROM); and other forms of the kind well known in the art or subsequently developed. The program of instructions may be "object code," i.e., in binary form that is executable more-or-less directly by the computer; in "source code" that requires compilation or interpretation before execution; or in some intermediate form such as partially compiled code. The precise forms of the program storage device and of the encoding of instructions are immaterial here. Aspects of the subject matter may also be configured to perform the described functions (via appropriate hardware/software) solely on site and/or remotely controlled via an extended communication (e.g., wireless, internet, satellite, etc.) network.

While the embodiments are described with reference to various implementations and exploitations, it will be understood that these embodiments are illustrative and that the scope of the inventive subject matter is not limited to them. Many variations, modifications, additions and improvements are possible. For example, various combinations of the features provided herein may be used.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

While the present disclosure describes various embodiments of a wireless transmission system, numerous modifications and variations will become apparent to those skilled in the art after studying the disclosure, including use of equivalent functional and/or structural substitutes for elements described herein. For example, some embodiments can be implemented for operation in combination with other known telemetry systems (e.g., mud pulse, fiber-optics, wired drill pipe, wireline systems, etc.). The disclosed techniques are not limited to any particular type of conveyance means or oilfield operation. For example, some embodiments are suitable for operations such as logging while drilling (LWD) and measurement while drilling (MWD), logging while tripping, marine operations, and so forth. It is intended that the following claims be interpreted to embrace all such variations and modifications.

What is claimed is:

1. A system for monitoring wellsite equipment at a wellsite, comprising:

a plurality of client devices, each of the plurality of client devices comprising a first radio and a second radio, a programmable channel of the first radio of a client device of the plurality of client devices being aligned to the programmable channel of the second radio of another client device of the plurality of client devices to define a two-way communication loop to communicate therebetween, the plurality of client devices comprising:

a source client device mounted to a portion of the wellsite equipment, the source client device further comprising a sensor to measure wellsite parameters of the wellsite equipment, wherein the sensor triggered to alter transmissions from the source client device when the source client device is within a range of another portion of the wellsite equipment;

a base station client device coupled to a surface unit to communicate therewith; and a repeater client device positioned at the wellsite to communicate with the source client device and the base station client device, and/or other repeater client devices, wherein a proximity switch mounted to the wellsite equipment, configured to, in response to the proximity switch being located within a given range from the source client device, the proximity switch configured to trigger the sensor of the source client device to terminate communication with the repeater client device and, in response to the proximity switch being located outside the given range from the source client device, the proximity switch configured to trigger the sensor of the source client device to initiate the communication with the repeater client device.

2. The system of claim 1, wherein the plurality of client devices further comprises at least one of an internal power supply, an external power supply, an encoder, additional sensors and electronics.

3. The system of claim 1, wherein said each of the plurality of client devices further comprises a housing with the first and second radios therein.

4. The system of claim 3, wherein the plurality of client devices further comprises a connector connectable to the housing and a cable extending from the connector for connection to additional components.

5. The system of claim 4, wherein the additional components comprise at least one of an external power supply, an encoder, additional sensors and electronics.

6. The system of claim 3, wherein the housing comprises a base and a cap.

7. The system of claim 3, wherein said each of the plurality of client devices further comprises an electronics board supported in the housing.

8. The system of claim 7, wherein the electronics board comprises at least one of a processor, a memory, an interface, an antenna, a power supply, and combinations thereof.

9. The system of claim 1, wherein the wellsite equipment comprises a link tilt, a top drive, an instrumented sub, a rig, and combinations thereof.

10. The system of claim 1, wherein the sensor further comprise at least one of a proximity sensor, a gyro, a magnetometer, a Hall effect sensor, an accelerometer, an encoder, a strain gauge, and combinations thereof.

11. The system of claim 1, further comprising a control and acquisition unit integral with or coupled to the surface unit.

12. The system of claim 11, wherein the control and acquisition unit comprises at least one of a processor, a controller, a network switch, a memory, a display device, a peripheral, and combinations thereof.

13. The system of claim 1, wherein the base station client device comprises a plurality of base station client devices, one of the plurality of base station client devices coupled to another of the plurality of base station client devices of the plurality of client devices, the surface unit, and combinations thereof.

14. The system of claim 1, further comprising communication links between the first and second radios, respectively, of said each of the plurality of client devices when at a same channel of the programmable channels of the first and second radios.

15. A system for monitoring wellsite equipment at a wellsite, comprising:

a surface unit positioned at the wellsite, the surface unit comprising a processor, a plurality of client devices, each of the plurality of client devices comprising a first radio and a second radio, a programmable channel of the first radio of a client device of the plurality of client devices being aligned to the programmable channel of the second radio of another client device of the plurality of client devices to define a two-way communication loop to communicate therebetween, the plurality of client devices comprising:

a source client device mounted to a portion of the wellsite equipment, the source client device further comprising a sensor to measure wellsite parameters of the wellsite equipment, wherein the sensor triggered to alter transmissions from the source client device when the source client device is within a range of another portion of the wellsite equipment;

a base station client device coupled to the surface unit to communicate therewith; and a repeater client device positioned at the wellsite to communicate with the source client device and the base station client device, and/or other repeater client devices, wherein a proximity switch mounted to the wellsite equipment, configured to, in response to the proximity switch being located within a given range from the source client device, the proximity switch configured to trigger the sensor of the source client device to terminate communication with the repeater client device and, in response to the proximity switch being located outside the given range from the source client device, the proximity switch configured to trigger the sensor of the source client device to initiate the communication with the repeater client device.

16. The system of claim 15, further comprising an identifier detectable by the sensor to determine a position of the wellsite equipment.

17. A method of monitoring a wellsite equipment at a wellsite, the method comprising:

positioning a plurality of client devices about the wellsite, each of the client devices comprising a first radio and a second radio;

assigning said each of the client devices roles as a source client device, a repeater client device, and a base station client device, the source client device being mounted to a portion of the wellsite equipment, the base station client device being positioned in a communication with a surface unit, and the repeater client device being positioned at the wellsite in the communication with the source client device and the base station client device;

configuring a two-way communication loop via a programmable channel of the first radio of a client device of the plurality of client devices being aligned to the programmable channel of the second radio of another client device of the plurality of client devices to communicate therebetween;

measuring wellsite parameters with a sensor of the source client device by triggering the sensor to alter transmissions from the source client device when the source client device is within a range of another portion of the wellsite equipment; and selectively transmitting, by the source client device, the wellsite parameters to the base station via the two-way communication loop of the programmable channels of the first and second radios, wherein a proximity switch mounted to the wellsite equipment, configured to, in response to the proximity switch being located within a given range from the source client device, the proximity switch configured to trigger the sensor of the source client device to terminate the communication with the repeater client device and, in response to the proximity switch being located outside the given range of the source client device, the proximity switch configured to trigger the sensor of the source client device to initiate the communication with the repeater client device.

18. The method of claim 17, further comprising collecting the wellsite parameters from external sensors with the source client device.

19. The method of claim 17, wherein the selectively transmitting comprises passing the wellsite parameters via the programmable channel of the first radio of the source client device to the programmable channel of the second radio of the base station client device.

20. The method of claim 17, wherein the selectively transmitting comprises passing the wellsite parameters via the programmable channel of the first radio of the source client device to the programmable channel of the second radio of the base station client device via the repeater client device.

21. The method of claim 17, wherein the selectively transmitting comprises passing the wellsite parameters from the base station client device to the surface unit.

22. The method of claim 17, wherein the selectively transmitting comprises receiving the wellsite parameters on a channel of the second radio of the repeater client device while simultaneously sending the wellsite parameters on a channel of the first radio of the repeater client device.

* * * * *